US009751062B2

(12) United States Patent
Barton et al.

(10) Patent No.: US 9,751,062 B2
(45) Date of Patent: Sep. 5, 2017

(54) MOBILE BLENDING APPARATUS FOR PROVIDING FLUIDS WITH PROPERTIES THAT VARY OVER TIME

(71) Applicant: Fluid Solution Technology, Inc., Austin, TX (US)

(72) Inventors: Stoney Brett Barton, Austin, TX (US); Christopher P. Thompson, Austin, TX (US); Richard L. Sohns, Round Rock, TX (US); Nick A. Eastman, Cedar Park, TX (US); Moussa M. Elias, Austin, TX (US); Reina J. Garcia, Sugar Land, TX (US)

(73) Assignee: FSTI, Inc., Austin, TX (US)

( * ) Notice: Subject to any disclaimer, the term of this patent is extended or adjusted under 35 U.S.C. 154(b) by 0 days.

(21) Appl. No.: 14/627,512

(22) Filed: Feb. 20, 2015

(65) Prior Publication Data

US 2015/0231584 A1 Aug. 20, 2015

Related U.S. Application Data

(63) Continuation of application No. 14/243,834, filed on Apr. 2, 2014.

(Continued)

(51) Int. Cl.
*B01F 13/00* (2006.01)
*B01F 15/04* (2006.01)

(52) U.S. Cl.
CPC ..... *B01F 15/0404* (2013.01); *B01F 13/0037* (2013.01); *B01F 2215/0081* (2013.01)

(58) Field of Classification Search
CPC ..... B01F 5/0412; B01F 2215/0081; G05D 11/139; E21B 43/26
See application file for complete search history.

(56) References Cited

U.S. PATENT DOCUMENTS 4,118,075 A 10/1978 Lubbehusen
4,265,266 A * 5/1981 Kierbow ..... G05D 11/132 137/101.19

(Continued)

FOREIGN PATENT DOCUMENTS

WO 2012071351 A1 5/2012

OTHER PUBLICATIONS

Supplementary European Search Report, Application No. 14780056, dated Oct. 31, 2016, 8 pages.

*Primary Examiner* — Tony G Soohoo
*Assistant Examiner* — Elizabeth Insler
(74) *Attorney, Agent, or Firm* — Meyertons, Hood, Kivlin, Kowert & Goetzel, P.C.

(57) ABSTRACT

A blending system includes one or more tank platforms. The tank platforms are transportable via road, rail, or vessel. One or more bulk containers are located on the tank platforms. The bulk containers are capable of storing and handling concentrated fluids. A blending platform may be coupled to the tank platforms. The blending platform is transportable via road, rail, or vessel. A blending unit is located on the blending platform. The blending unit blends the concentrated fluids with one or more of the additive fluids and water to continuously produce desired fluids as needed. The desired fluids may be used in a well in a subsurface of the earth. The flow of concentrated fluids and water may be automatically controlled to provide the desired fluid with one or more properties that vary over time with a selected variation profile.

20 Claims, 22 Drawing Sheets

Related U.S. Application Data

(60) Provisional application No. 61/807,569, filed on Apr. 2, 2013, provisional application No. 61/936,560, filed on Feb. 6, 2014.

(56) References Cited

U.S. PATENT DOCUMENTS

| | | | | |
|---|---|---|---|---|
| 4,538,221 | A * | 8/1985 | Crain | G05D 11/139 137/101.19 |
| 4,878,758 | A | 11/1989 | Schafer et al. | |
| 2001/0000996 | A1 | 5/2001 | Grimland et al. | |
| 2003/0161212 | A1 | 8/2003 | Neal et al. | |
| 2005/0286340 | A1 | 12/2005 | Urquhart | |
| 2011/0272155 | A1 | 11/2011 | Warren | |
| 2013/0142601 | A1 | 6/2013 | McIver et al. | |
| 2016/0265330 | A1* | 9/2016 | Mazrooee | E21B 43/267 |

* cited by examiner

MOBILE BLENDING APPARATUS FOR PROVIDING FLUIDS WITH PROPERTIES THAT VARY OVER TIME

PRIORITY CLAIM

This patent is a continuation of U.S. patent application Ser. No. 14/243,834 entitled "MOBILE BLENDING APPARATUS" to Barton et al., filed on Apr. 2, 2014, which claims priority to U.S. Provisional Patent Application Ser. No. 61/807,569 entitled "MOBILE BLENDING APPARATUS" to Barton filed on Apr. 2, 2013; and U.S. Provisional Patent No. 61/936,560 entitled "MOBILE BLENDING APPARATUS" to Barton filed on Feb. 6, 2014, all of which are incorporated by reference in their entirety.

BACKGROUND

1. Field of the Invention

The present invention relates to portable and mobile chemical blending platforms. More particularly, the invention relates to a mobile blending platform for continuously producing fracking fluids with adjustable concentrations.

2. Description of Related Art

Batch blending systems are commonly used to provide fluids used at process sites. For example, batch blending systems may be used on-site (at the process location) to produce diluted acids used for fracking. Batch blending systems produce a fixed amount (a batch) of end material (e.g., diluted acid) per process. Because a fixed amount is produced, batch blending may, however, create waste and excess diluted material if the amounts of fluid needed differ from the amounts produced.

Batch blending processes may also produce fumes and/or other by-products that need to be neutralized and/or disposed of properly. In addition, using a batch process to provide fluids at the process site does not allow for real-time variation in the composition of the fluid if, for example, process parameters change or blending conditions change. Batch blending systems may also be bulky and difficult to transport.

Thus, there is a need for a mobile (portable) blending system that provides real-time (continuous) blending to produce desired product fluids on-site. The blending system may also include systems and/or apparatus for processing excess fumes and/or excess waste and systems and/or apparatus for containing fluid leaks or spills.

SUMMARY

In certain embodiments, a blending system includes one or more tank platforms. The tank platforms are transportable via road, rail, or vessel. One or more bulk containers are located on the tank platforms. The bulk containers are capable of storing and handling concentrated fluids. A blending platform may be coupled to the tank platforms. The blending platform is transportable via road, rail, or vessel. In some embodiments, one or more intermediate containers are located on the blending platform. The intermediate containers may be capable of storing and handling additive fluids and/or dry additives. A blending unit is located on the blending platform. The blending unit blends the concentrated fluids with one or more of the additive fluids and water to continuously produce desired fluids with a selected concentration of concentrated fluid, additive fluid, and water. In certain embodiments, the desired fluids are fracking fluids.

In certain embodiments, the blending platform includes a controller coupled to the blending unit. The controller may control the flow of fluids through the blending unit. The controller may collect data of one or more properties of the produced desired fluids and adjust the flow of fluids in response to the properties of the produced desired fluids. In some embodiments, the controller provides the produced desired fluids with one or more properties that vary over time with a selected variation profile. The selected variation profile may be determined by the controller based on one or more inputs provided by a user in combination with data collected by the controller from one or more measurement devices located on the blending platform.

In some embodiments, the blending platform includes a containment system. The containment system substantially contains leaks and/or spills from the bulk containers and the blending platform during use. In some embodiments, the blending platform includes a scrubber/recovery system located on the blending platform. The scrubber/recovery system collects vapors from the bulk containers and/or the blending unit, allows the vapors to concentrate and condense, and provides the condensed vapor to one or more of the bulk containers.

In certain embodiments, a continuous, real-time blending process includes providing a flow of compressed air to one or more bulk containers to provide one or more flows of concentrated fluids from the bulk containers. The flows of concentrated fluids from the bulk containers may be combined. The combined flow of concentrated fluids may be continuously blended with water to produce a desired fluid (e.g., a fracking fluid) with a selected concentration of concentrated fluids and water. The desired fluid may be continuously provided to a subsurface process (e.g., a subsurface fracking process). In some embodiments, a flow of one or more additive fluids and/or dry additives is combined to the desired fluid to produce the desired fluid with a selected concentration of concentrated fluids, additive fluids, dry additives, and water.

In some embodiments, one or more properties of the produced desired fluid are assessed (e.g., are assessed in real-time). The flow of concentrated fluids and water may be controlled in response to the assessed properties of the produced desired fluid. In some embodiments, the flow of concentrated fluids and water is controlled to provide the desired fluid with one or more properties that vary over time with a selected variation profile.

In some embodiments, vapors produced in the bulk containers and vapors produced from the blending of the combined flow of concentrated fluids and water are collected. The collected vapors may be condensed. At least some of the condensed vapors may be provided to one or more of the bulk containers. In some embodiments, at least some of the vapors produced in the bulk containers and produced from the blending of the combined flow of concentrated fluids and water are scrubbed. The scrubbed vapors may be condensed in a scrubber tank and combined with the condensed collected vapors before providing the condensed vapors to one or more of the bulk containers.

BRIEF DESCRIPTION OF THE DRAWINGS

Features and advantages of the methods and apparatus of the present invention will be more fully appreciated by reference to the following detailed description of presently preferred but nonetheless illustrative embodiments in accordance with the present invention when taken in conjunction with the accompanying drawings in which.

Figure 1:
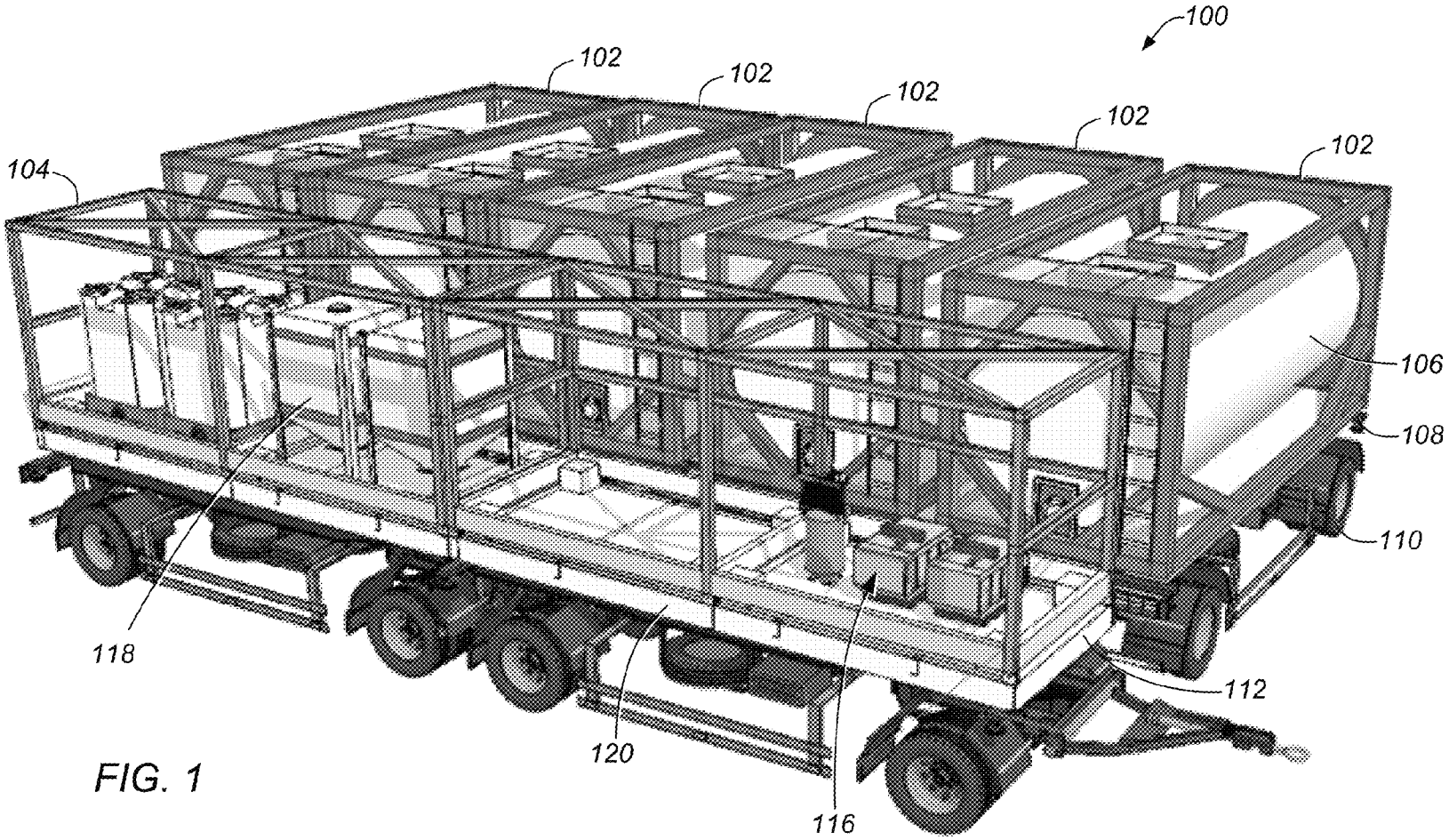
FIG. 1 depicts a representation of an embodiment of a blending system.

While the invention is susceptible to various modifications and alternative forms, specific embodiments thereof are shown by way of example in the drawings and will herein be described in detail. The drawings may not be to scale. It should be understood that the drawings and detailed description thereto are not intended to limit the invention to the particular form disclosed, but to the contrary, the intention is to cover all modifications, equivalents and alternatives falling within the spirit and scope of the present invention as defined by the appended claims.

DETAILED DESCRIPTION OF EMBODIMENTS

In the context of this patent, the term "coupled" means either a direct connection or an indirect connection (e.g., one or more intervening connections) between one or more objects or components. The phrase "directly connected" means a direct connection between objects or components such that the objects or components are connected directly to each other so that the objects or components operate in a "point of use" manner.

FIG. 1 depicts a representation of an embodiment of blending system 100. Blending system 100 includes one or more tank platforms 102 and blending platform 104. Blending system 100 may be used to produce fluids (e.g., fracking fluids) at a location of a process site (e.g., a fracking site). Fracking fluids may include, but not be limited to hydraulic fluids used in high pressure hydraulic fracturing pumps as part of an acidizing process. The fracking fluids may be provided to a subsurface process site in the subsurface of the earth (below the surface of the earth). Blending system 100 may, in some embodiments, provide fluids used for other oil field and/or drilling services. For example, blending system 100 may provide fluids for use in an oil field for stimulation and/or injection into hydrocarbon wells in the subsurface (e.g., hydrocarbon (oil) production wells).

Blending system 100 may be transportable to/from the process site (e.g., the blending system is mobile or portable). For example, blending system 100 may be transportable via road, rail, or vessel between the process site and a chemical storage facility (e.g., a chemical warehouse or distribution center).

In certain embodiments, tank platforms 102 and blending platform 104 are separately transportable. Thus, tank platforms 102 and blending platform 104 may be transported either individually or as a unit. For example, in one embodiment, blending platform 104 may be transported to the process site and remain there while tank platforms 102 are transported back and forth between the process site and the storage facility.

In certain embodiments, tank platforms 102 include one or more bulk containers 106. Bulk containers 106 may be storage containers capable of storing and handling desired fluids (e.g., concentrated fluids). Examples of fluids that may be handled in bulk containers 106 include, but are not limited to, hydrochloric acid (HCl), caustic soda, and calcium chloride. Other examples of fluids that may be handled in bulk containers include, but are not limited to, KOH, acetic acid ($CH_3COOH$), NaOH, and hydroflouric acid (HF). In certain embodiments, bulk containers 106 include highly concentrated fluids (e.g., non-diluted acids or bases). In some embodiments, bulk containers 106 are capable of handling volumes of about 5,000 gallons or more. In certain embodiments, bulk containers 106 are ISO Tank containers.

Bulk containers 106 may be placed on trailers 108 for transport of the bulk containers. In certain embodiments, single bulk container 106 is placed on single trailer 108. In some embodiments, more than one bulk container 106 is placed on a single trailer 108. Trailer 108 may include wheels 110 or other structures that allow for mobility and transport of the trailer and bulk containers 106 via road, rail, and/or vessel.

In certain embodiments, bulk containers 106 and trailers 108 include structures for compliance with DOT regulations for over-the-road transportation of chemical volumes. For example, they may include baffles or other suitable safety equipment. In certain embodiments, bulk containers 106 include telemetry and/or other equipment for monitoring the volume in the containers. In some embodiments, the volume is monitored remotely using the telemetry equipment.

In certain embodiments, blending platform 104 is placed on trailer 112. Trailer 112 may be similar to trailers 108. For example, trailer 112 may include wheels 114 or other structures that allow for mobility and transport of the trailer and blending platform 104 via road, rail, and/or vessel.

In certain embodiments, blending platform 104 includes blending unit 116. Blending unit 116 may include, for example, process equipment for mixing and blending acids or bases with additives and/or water to produce diluted acids or bases. Process equipment may include, but not be limited to, pumps, valves, generators, air compressors, flow meters, common headers, storage tanks, piping, telemetry systems, and connections to external systems.

In certain embodiments, blending platform 104 includes one or more containers 118. Containers 118 may be, for example, intermediate bulk containers. Containers 118 may be used to store and handle additives used in a blending process with fluids from bulk containers 106. Examples of additives that may be in containers 118 include, but are not limited to, corrosion inhibitors, surfactants, lime, other acids, and water. Additives may be either liquid or dry additives. In some embodiments, an external water source is coupled to blending platform 104 to provide water to blending unit 116.

In some embodiments, blending platform 104 includes containment system 120. Containment system 120 may be used to contain leaks or spills on blending platform 104 and/or between the blending platform and bulk containers 106 (e.g., spills from piping connections and/or valves between the blending platform and the bulk containers). Containment system 120 inhibits or prevents spills or leaks from contaminating the environment surrounding blending platform 104 and bulk containers 106.

Figure 2:
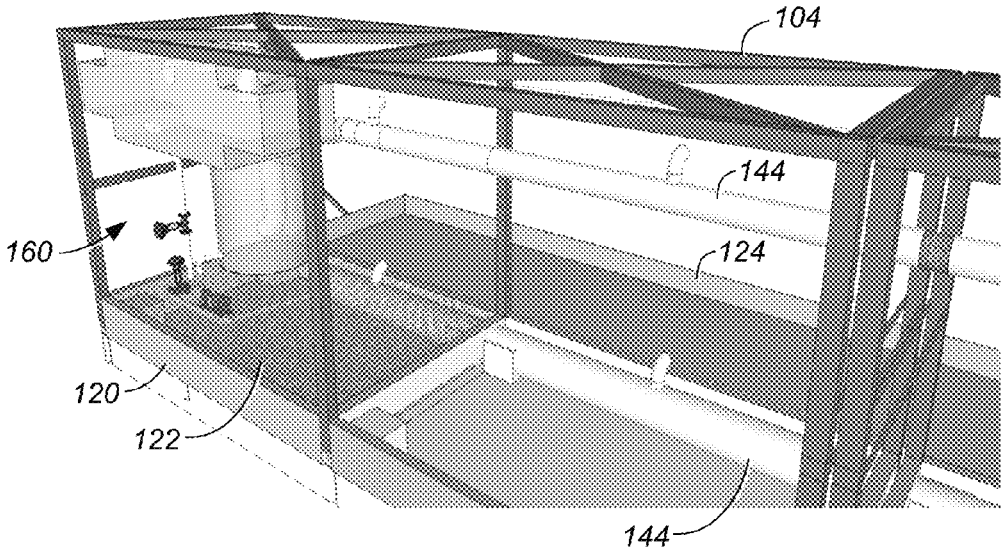
FIG. 2 depicts an enlarged view of a blending platform.
Figure 3:
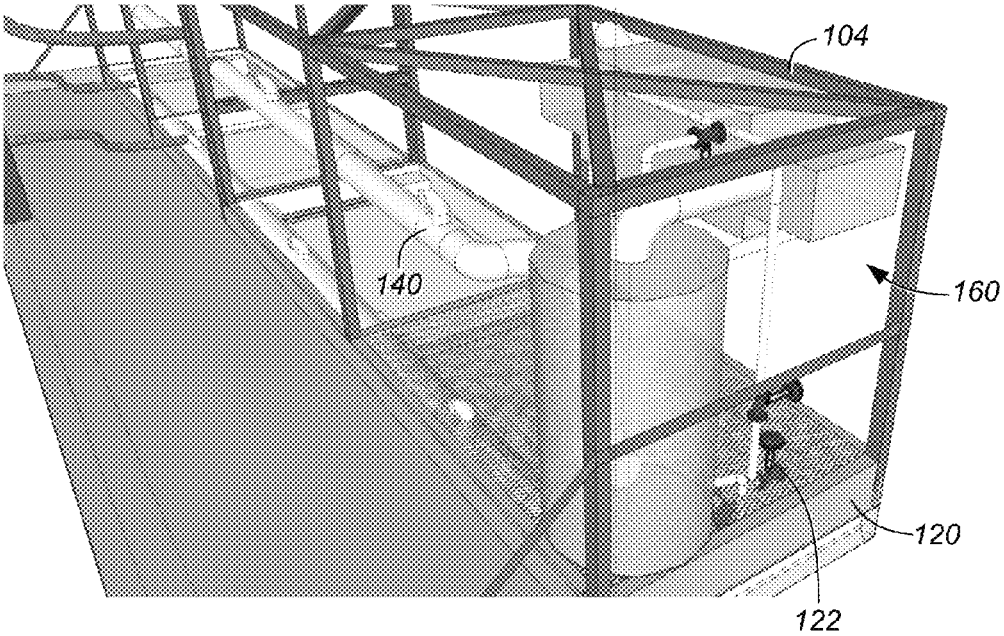
FIG. 3 depicts another enlarged view of a blending platform.

FIGS. 2 and 3 depict enlarged views of blending platform 104. Portions of containment system 120 are shown in FIGS. 2 and 3. In some embodiments, containment system 120 includes raised flooring 122 to contain spills or leaks on blending platform 104. Raised flooring 122 may be, for example, a raised, fiber grated flooring to provide containment volume below blending unit 116, containers 118, and/or other equipment on blending platform 104.

In some embodiments, containment system 120 includes secondary containment 124. Secondary containment 124 may be, for example, a containment basin coupled to blending platform 104. In certain embodiments, secondary containment 124 is integrated into trailer 112 of blending platform 104. For example, secondary containment 124 may be a skirt or skirt extension coupled to trailer 112. In some embodiments, secondary containment 124 is a flexible and/or collapsible containment basin made of, for example, polyurethane.

Figure 4:
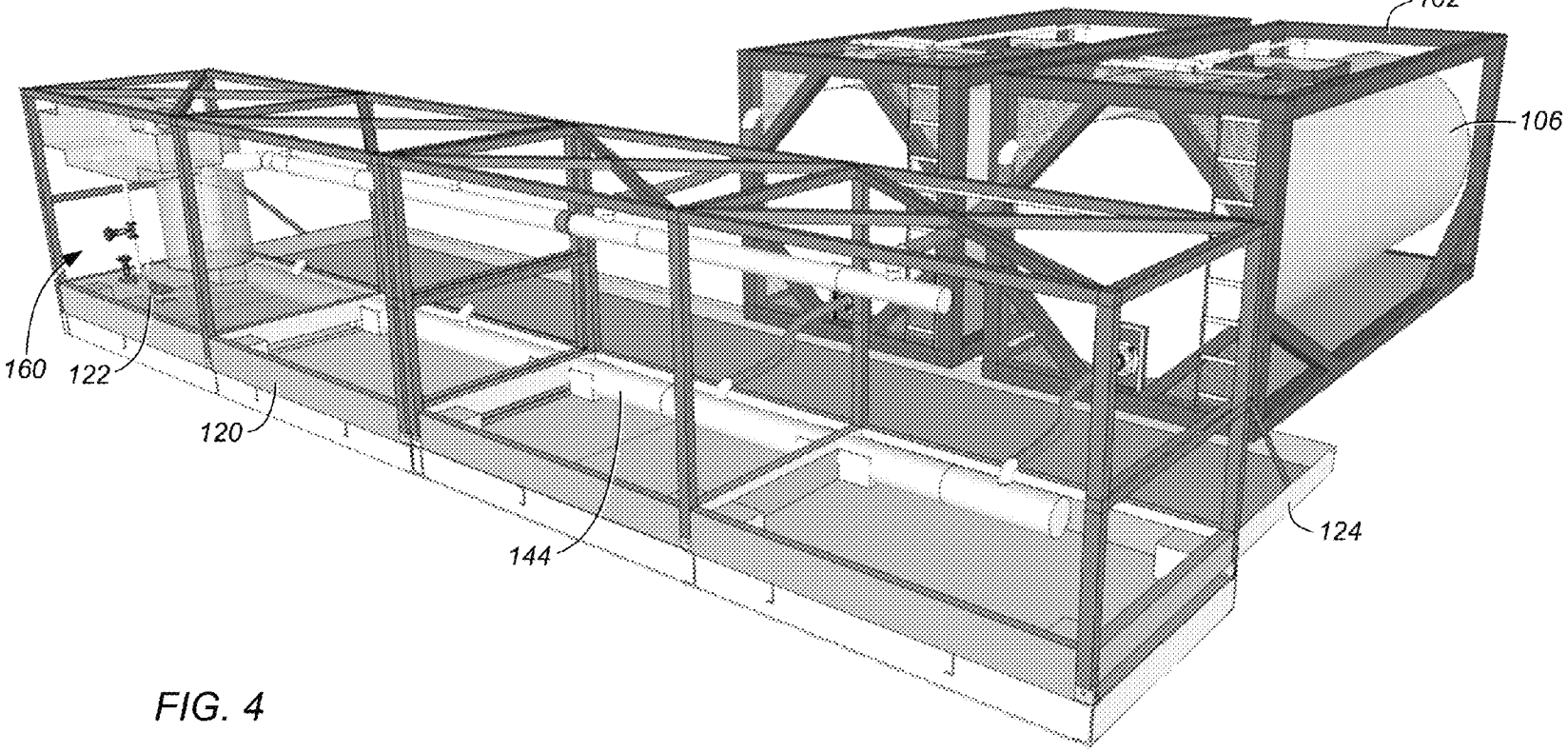
FIG. 4 depicts a representation of an embodiment of a blending platform coupled to tank platforms with a secondary containment system in the working position.

In some embodiments, secondary containment 124 is moveable between a transport position (for transport of the blending platform) and a working position (for use during blending processes). For example, secondary containment 124 may be coupled to trailer 112 with a pivot joint to allow rotation of the secondary containment into a working position. Secondary containment 124 is shown in the working position in FIGS. 2 and 3. FIG. 4 depicts a representation of an embodiment of blending platform 104 coupled to tank platforms 102 with secondary containment system 124 in the working position. In the working position, secondary containment 124 extends from the side of blending platform 104 to contain spills and/or leaks in the areas on and between the blending platform and tank platforms 102. Thus, secondary containment 124 extends from blending platform 104 when bulk containers 106 are coupled to the blending platform to surround and contain all connections between the platforms and prevent spill and/or leakage of hazardous materials.

Figure 5:
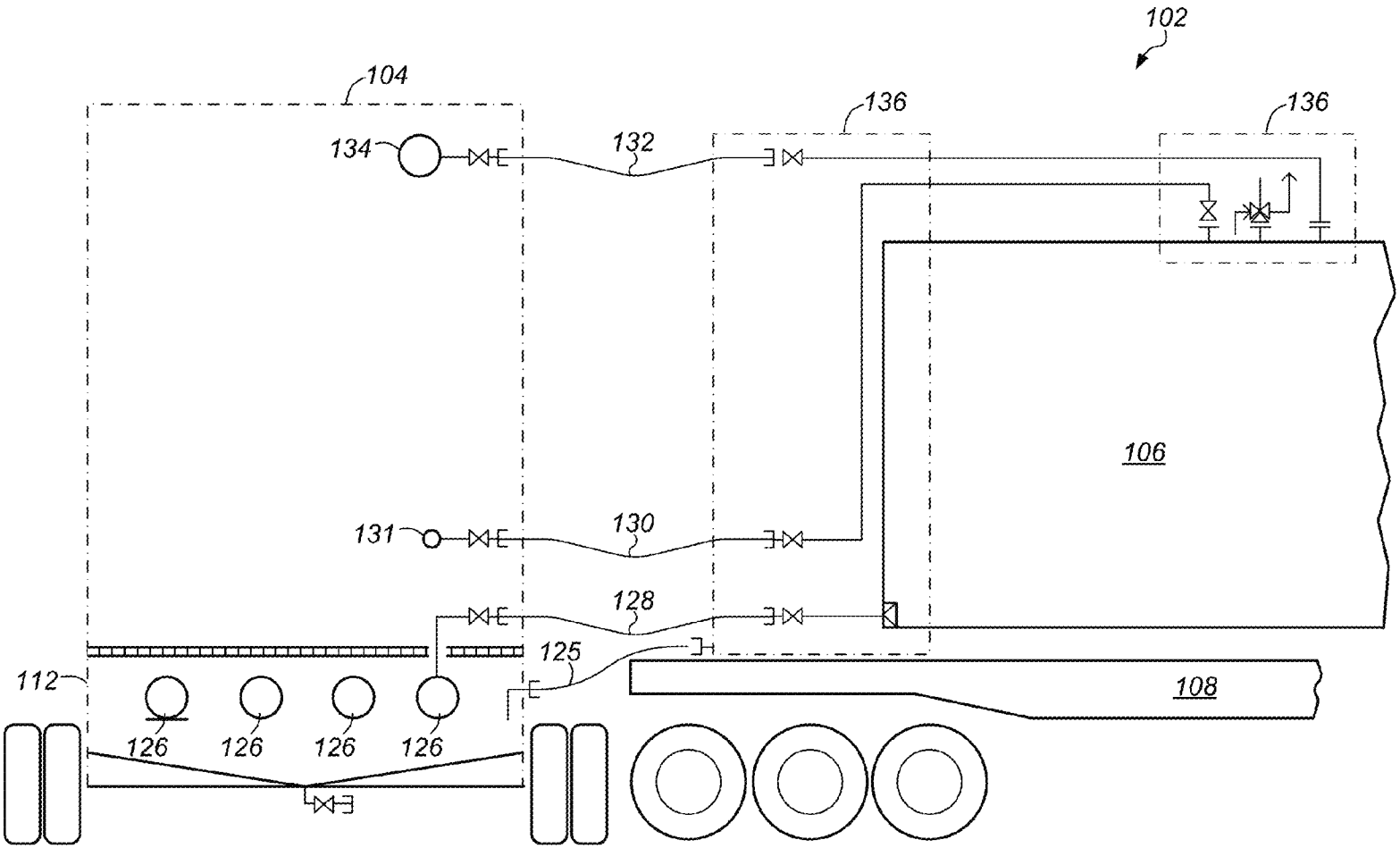
FIG. 5 depicts a schematic of an embodiment of a blending platform coupled to a tank platform and a bulk container.

FIG. 5 depicts a schematic of an embodiment of blending platform 104 coupled to tank platform 102 and bulk container 106. In certain embodiments, blending platform 104 and tank platform 102 are coupled with coupler 125. Coupler 125 may secure blending platform 104 and tank platform 102 to each other to inhibit the blending platform and the tank platform from disattaching and leaking fluids during use (e.g., during blending operations or transfer of fluids between the platforms). Coupler 125 may be, for example, a cable or other high mechanical strength coupling between blending platform 104 and tank platform 102.

In certain embodiments, blending platform 104 includes one or more fluid couplings 126. Fluid couplings 126 may include, for example, coupling for connecting piping (e.g., hoses) between bulk container 106 and blending platform 104. Fluid couplings 126 may be suitable for varying types of fluids (e.g., water, acids, and/or bases). Fluid couplings 126 may also be capable of handling different size fittings (e.g., 6", 8", and/or 10" fittings). In certain embodiments, fluids couplings 126 are coupled to header lines located on blending platform 104. The header lines may be coupled to blending unit 116, shown in FIG. 1, or any other process unit located on blending platform 104.

In certain embodiments, fluid coupling 126 is coupled to bulk container 106 using connector 128. Connector 128 may be, for example, a hose connector capable of handling hazardous materials such as acids or bases. Connector 128 may be used to provide concentrated bulk fluids from bulk container 106 to blending unit 116. In some embodiments, connector 130 is coupled between a vapor side of bulk container 106 and coupling 131 on blending platform 104 (e.g., blending unit 116). Connector 130 and coupling 131 may be used to transfer material between various bulk containers 106. In some embodiments, connector 132 is coupled between a vapor side of bulk container 106 and vent coupling 134. Vent coupling 134 may be coupled to, for example, a header for a scrubber system or other system for handling fumes (vapors) generated in bulk container 106.

In certain embodiments, containment 136 is provided around connections on bulk container 106. For example, containment 136 may be provided around vapor connections on top of bulk container 106 and/or liquid connections at the bottom of the bulk container, as shown in FIG. 5. In some embodiments, containment 136 around vapor connections on top of bulk container 106 includes a spill box. In some embodiments, containment 136 is part of or integrated with containment system 120 and/or secondary containment 124, shown in FIGS. 1-4. For example, fluids from containment 136 may be transferred to containment system 120 and/or secondary containment 124.

Figure 6:
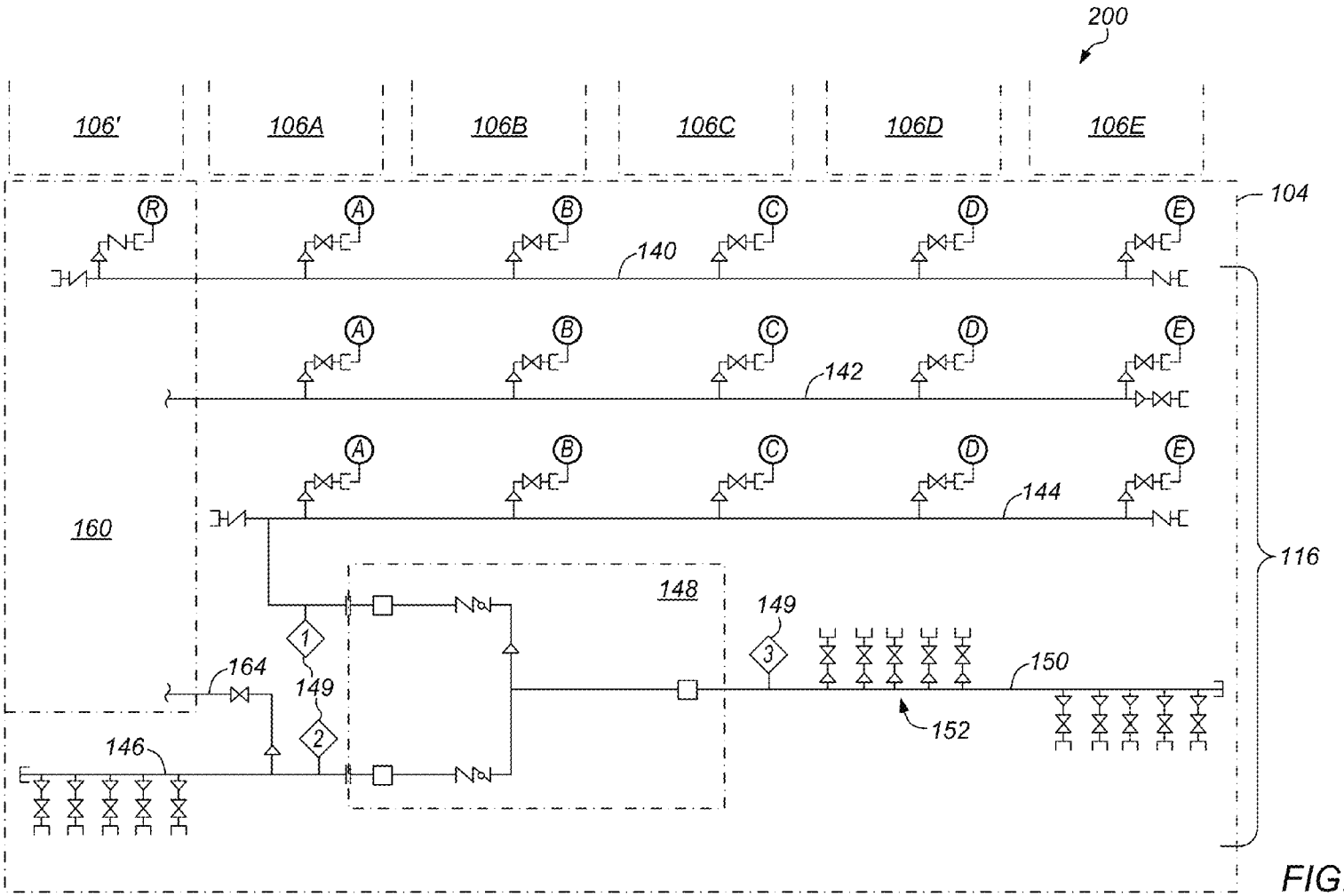
FIG. 6 depicts an embodiment of a blending scheme.

FIG. 6 depicts an embodiment of a blending scheme. Blending scheme 200 may include blending unit 116. Blending unit 116 may be located on blending platform 104 or another blending platform disclosed herein. In certain embodiments, blending unit 116 includes one or more headers 140, 142, and 144. Headers 140, 142, 144 may be, for example, headers for handling hazardous fluids such as acids or bases. Headers 140, 142, 144 may be coupled to each of bulk containers 106A-E through corresponding valves labeled A-E on each header.

In some embodiments, header 140 is a vent header coupled to bulk containers 106. Header 140 may be coupled to bulk containers 106 through, for example, connector 132 and vent coupling 134, shown in FIG. 5. Header 140, as shown in FIG. 6, may be coupled to scrubber system 160 to handle vapors from bulk containers 106. FIGS. 2-4 also show header 140 coupled to bulk containers 106 and scrubber system 160.

Figure 9:
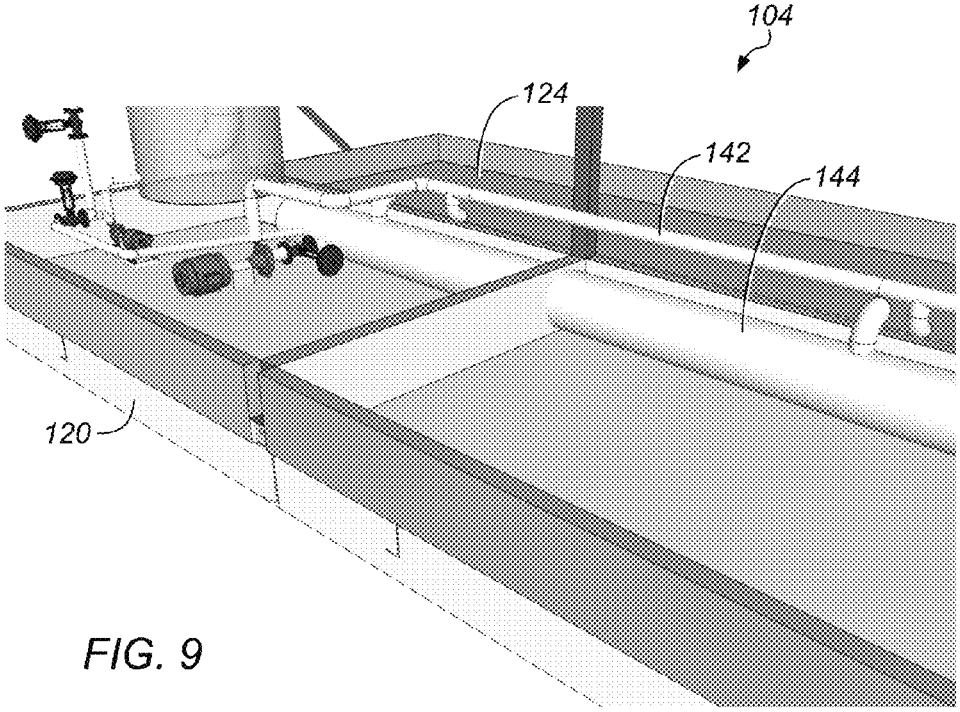
FIG. 9 depicts an enlarged view of a blending platform with a header.

In some embodiments, header 142 is a fill header or other small diameter header. For example, header 142 may be used to provide air or other fluid to pressurize the bulk containers and produce a flow of concentrated fluids from the bulk containers. In some embodiments, header 142 is used to transfer materials between bulk containers 106, as needed. FIG. 9 depicts an enlarged view of blending platform 104 with header 142. Header 142 may be coupled to bulk containers 106 through, for example, connector 130 and coupling 131, shown in FIG. 5.

In some embodiments, header 144 is used to provide fluids from bulk containers 106 to blending unit 116. Header 144 may be coupled to bulk containers 106 through, for example, connector 128 and fluid coupling 126, shown in FIG. 5. FIGS. 2-4 also show header 144 coupled to bulk containers 106.

As shown in FIG. 6, blending unit 116 combines flow from header 144 with flow from water header 146 to dilute fluids from bulk containers 106 in dilution manifold 148. Water may be provided from water tanks, or another suitable water source, coupled to blending platform 104 (e.g., through at least one fluid coupling 126, shown in FIG. 5). In certain embodiments, flowmeters 149 are used to monitor flow from header 144 and/or water header 146. In some embodiments, pumps are used to provide fluids from the headers 144, 146 to dilution manifold 148. Dilution manifold 148 may also include one or more check valves to inhibit backflow from the dilution manifold. The diluted fluid is provided into header 150 (e.g, a 10" acid header). In some embodiments, flowmeter 149 is used to assess flow of the diluted fluid in header 150.

Figure 7:
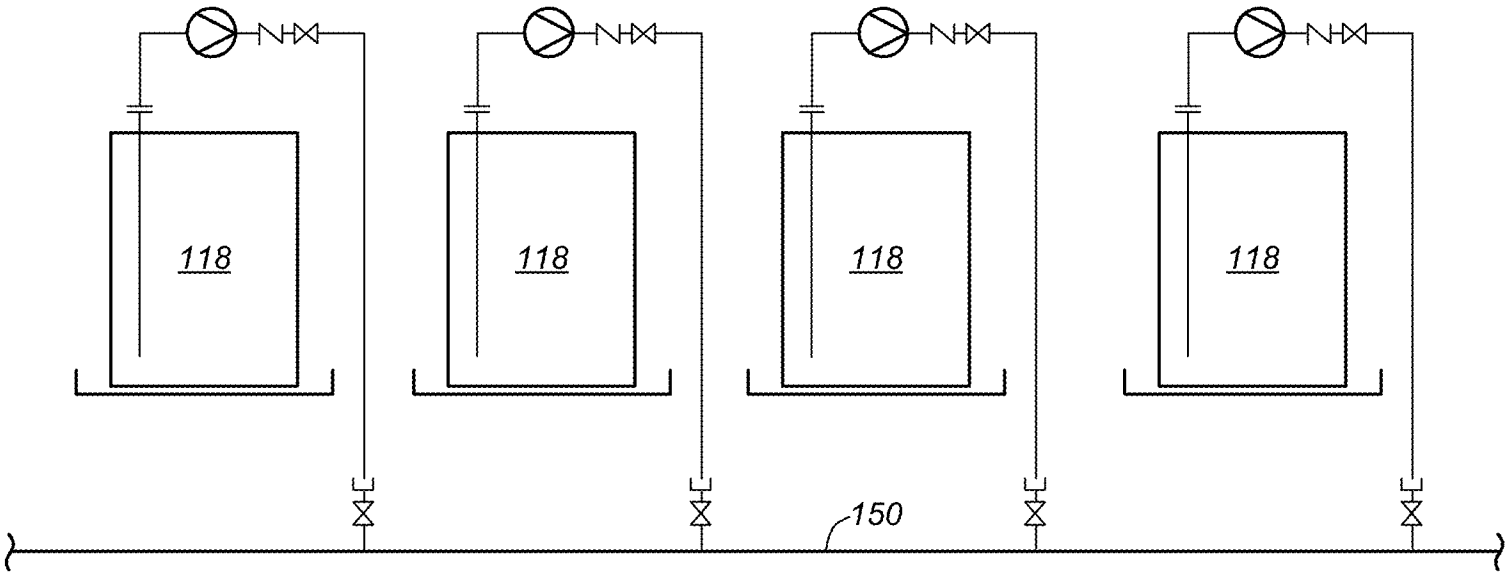
FIG. 7 depicts a schematic of an embodiment of an additive section with containers.

After fluids are diluted in dilution manifold 148, one or more additives may be provided to the diluted fluid in header 150 at additive section 152. Additives may be provided from, for example, containers 118, shown in FIG. 1. FIG. 7 depicts a schematic of an embodiment of additive section 152 with containers 118. Additives may be provided to produce final desired fluids (e.g., fracking fluids) for use at the process site. Each container 118 and/or additive line may include devices (e.g., flowmeters and/or telemetry) to monitor the amount of each additive being provided to header 150. As the additives may be either in liquid or dry form, various types of metering, measuring, and/or conveyance systems may be coupled between container 118 and header 150.

The final desired fluids may be provided using one or more couplings (e.g., fluid coupling 126, shown in FIG. 5). The couplings may be, for example, hose connectors for connecting to one or more hoses supplied to the process site.

Figure 8:
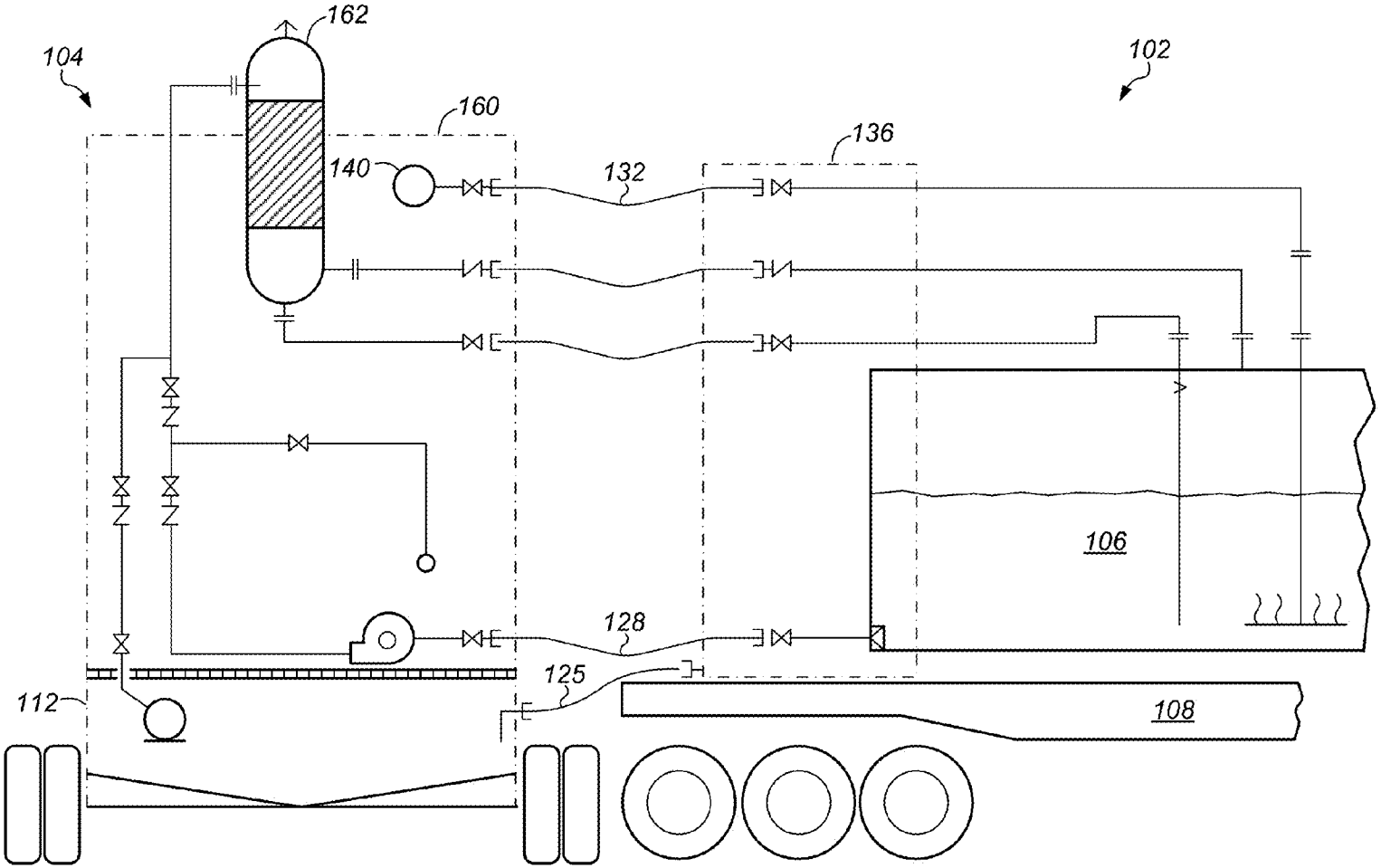
FIG. 8 depicts a schematic of an embodiment of a scrubber system on a blending platform.

FIG. 8 depicts a schematic of an embodiment of scrubber system 160 on blending platform 104. Scrubber system 160 may be used to capture fumes (vapors) from one or more of bulk containers 106 (e.g., through header 140 coupled to the bulk containers). In certain embodiments, scrubber system 160 is coupled to blending unit 116 to capture and clean any vapor by-products released as a result of mixing, blending, filling, and/or transferring of fluids in the blending process.

In certain embodiments, scrubber system 160 includes capture tank 162. Capture tank 162 may be used to collect vapors from bulk containers 106 and/or blending unit 116. The vapors may be stored in capture tank 162 until the vapors concentration reaches a level to form liquid (e.g., dilute acid). The liquid then may be recycled into blending unit 116 (e.g, using header 164 shown in FIG. 6) to recycle the captured vapors into the product. Recovering the product by capturing and recycling reduces waste, reduces acid fumes on site, and reduces any need for neutralizing and disposing of chemical waste associated with excess vapors.

Figure 10:
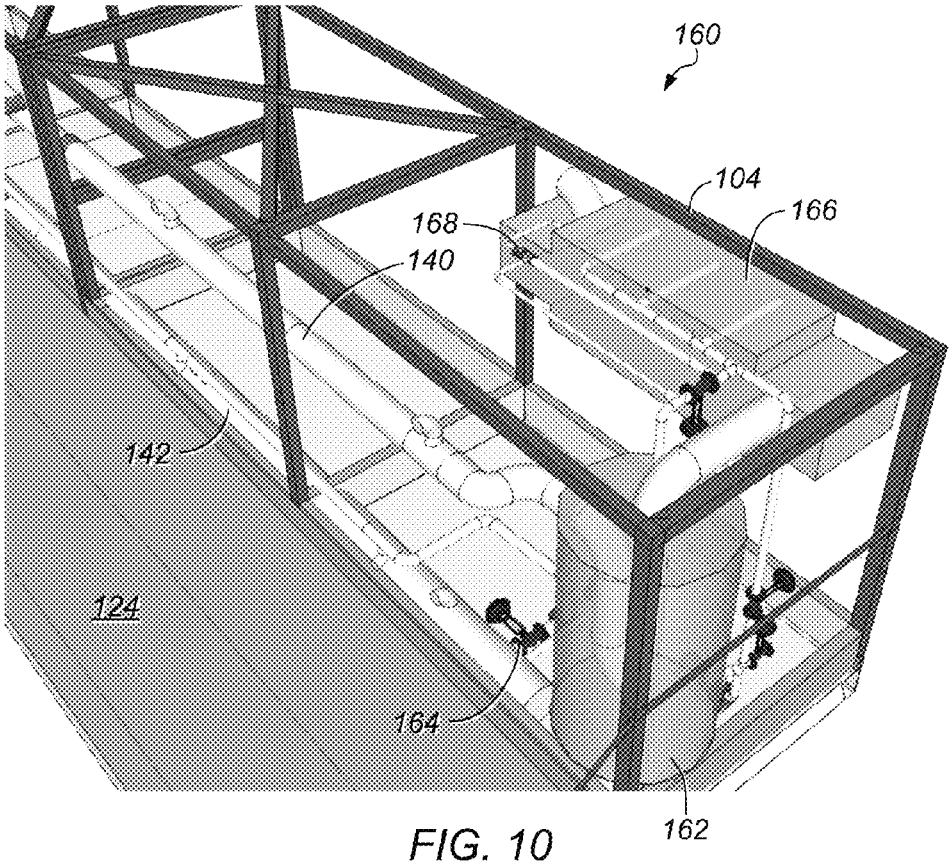
FIG. 10 depicts an enlarged view of a blending platform showing another embodiment of scrubber system.

FIG. 10 depicts an enlarged view of blending platform 104 showing another embodiment of scrubber system 160. In certain embodiments, scrubber system 160 includes spray box 166 and/or eductor 168. Eductor 168 may be used to increase the flow of vapors from bulk containers 106 and/or from blending unit 116 into the scrubber system (e.g., into spray box 166). Eductor 168 may, for example, provide a negative pressure to actively draw vapors from bulk containers 106 and/or from blending unit 116 into spray box 166.

In certain embodiments, vapor (fumes) are sent to spray box 166 and water from tank 162 is sprayed over the vapors in the spray box until the concentration of the water volume in the box reaches a sufficient concentration to be sent through header 164 to the acid header (e.g., header 144 or header 150). After the concentrated volume is sent to the acid header, water may be resupplied to tank 162 (to replace the volume used in spray box 166) and the concentration process may be repeated.

Figure 11:
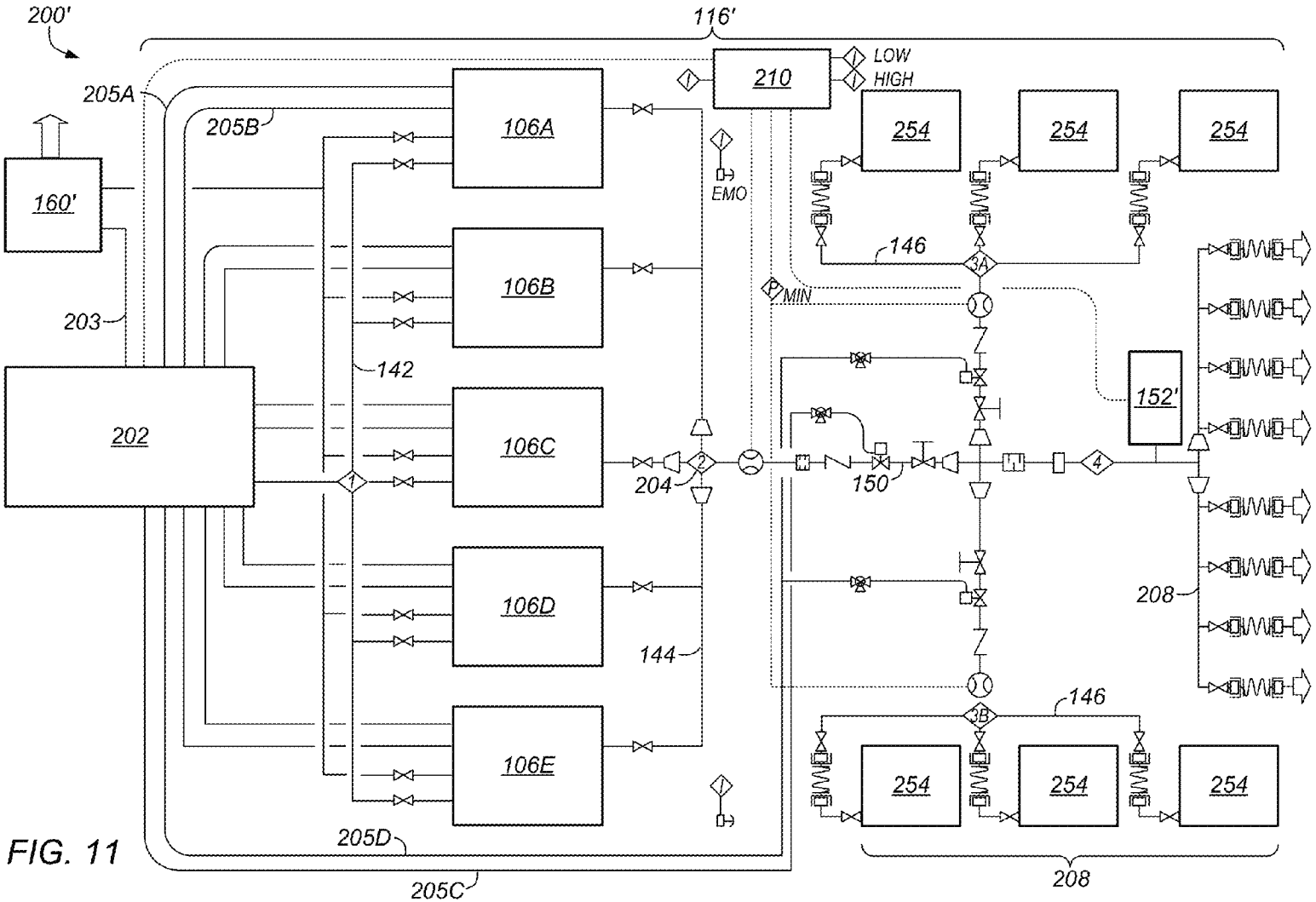
FIG. 11 depicts another embodiment of a blending scheme.

FIG. 11 depicts another embodiment of a blending scheme. Blending scheme 200' may include blending unit 116'. Blending unit 116' may be located on blending platform 104 or another blending platform disclosed herein. Blending unit 116' includes headers 140, 142, 144 coupled to each of bulk containers 106A-E through corresponding valves on each header. In some embodiments, header 140 is a fill header coupled to bulk containers 106. Header 140 may be coupled to bulk containers 106 through, for example, valves. Header 140, as shown in FIG. 11, may be coupled to scrubber system 160' to fill bulk containers 106 with fluids recovered using the scrubber system (e.g., concentrated fluids such as acid recovered by the scrubber system).

In certain embodiments, header 142 is a small diameter header (e.g., a 2" or a 3" header) or other header suitable for flow of compressed air or another gas. In certain embodiments, header 142 is coupled to process air system 202. Process air system 202 and header 142 may be used to provide air (or another suitable fluid) to pressurize/depressurize bulk containers 106 and produce a controlled flow of concentrated fluids from the bulk containers. Pressurizing bulk containers 106 may increase the flow of concentrated fluids from the bulk containers while depressurizing the bulk containers may decrease the flow of concentrated fluids from the bulk containers. During depressurization of bulk containers 106, vented air/concentrated fluid vapors may be sent to scrubber system 160' from process air system 202 using vent 203. In some embodiments, header 142 is used to transfer materials between bulk containers 106, as needed.

In certain embodiments, vent lines 205A-D capture fumes, vapors, or other fluids from one or more locations in bulk containers 106 and blending unit 116', as shown in FIG. 11. Vent lines 205A-D may provide the captured fluids to process air system 202, which may then vent the captured fluids to scrubber system 160' through vent 203. In some embodiments, vent line 205B is used to depressurize bulk containers 106.

In certain embodiments, header 144 is used to provide fluids from bulk containers 106 to blending unit 116'. Header 144 may be coupled to bulk containers 106 through valves, as shown in FIG. 11. Fluids in header 144 may be combined at 204 and provided to header 150 in sub-blending system 206. Header 150 may be, for example, a blend header. Fluids in header 150 may be diluted and/or blended with additives to provide final fluids to product header 208.

In certain embodiments, fluids in header 150 are diluted with water from water header 146. Water may be provided from water tanks, or another suitable water source, provided by a customer and coupled to blending platform 104. Flowmeters and/or other data collection devices may be used to monitor dilution of fluids in header 150.

After dilution of fluids in header 150, additives may be provided to the diluted fluids from additive section 152'. Following the addition of additives, the final product fluids may be provided to product header 208. Product header 208 may be coupled hoses or other hook-ups that allow the customer to provide the fluids to a treatment site or other blending process as needed.

Figure 12:
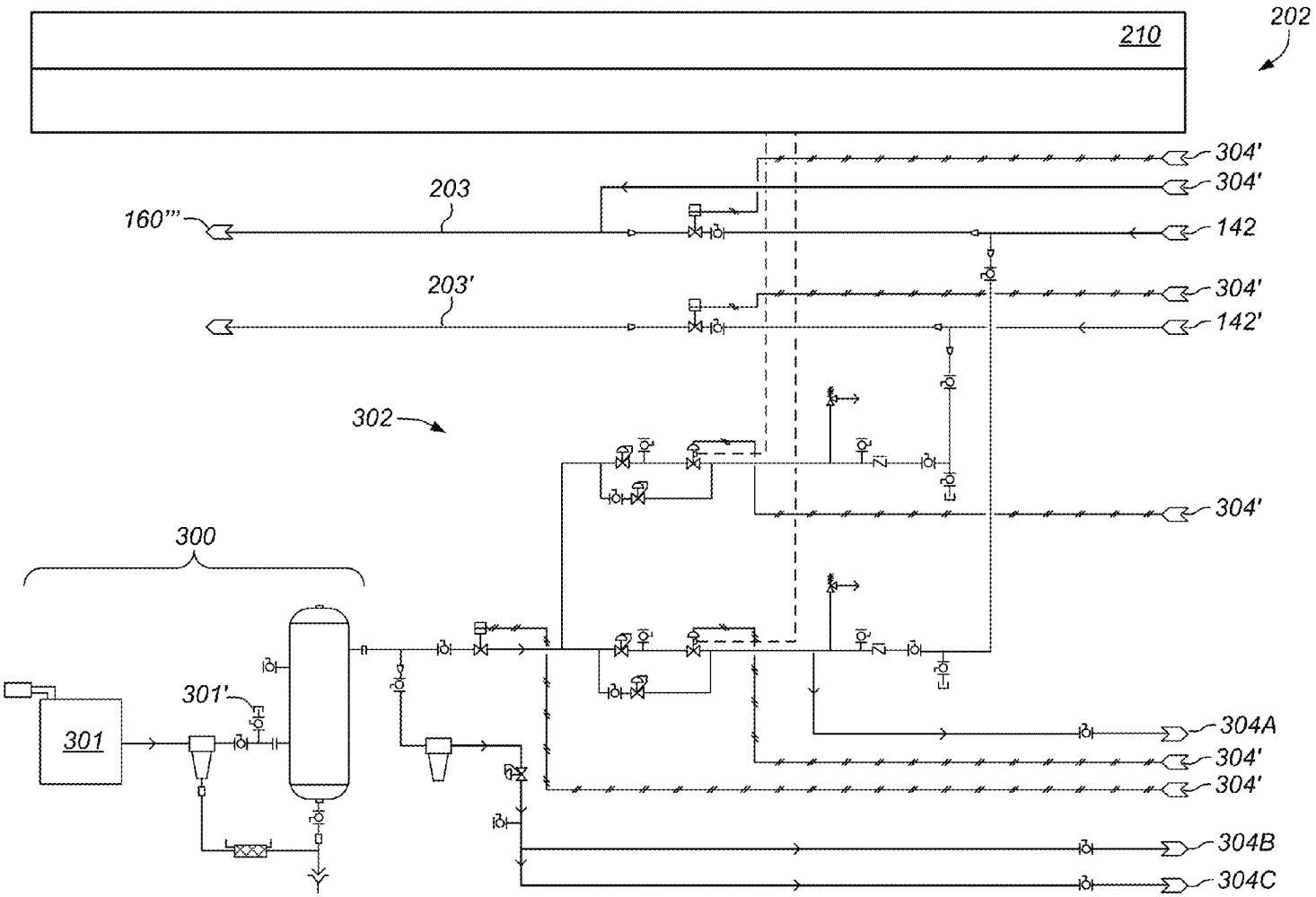
FIG. 12 depicts a schematic of an embodiment of a process air system.

FIG. 12 depicts a schematic of an embodiment of process air system 202. Process air system 202 may be used in, for example, blending scheme 200' or any other blending scheme disclosed herein. Process air system 202 may provide compressed air to the blending scheme. Compressed air may be used, for example, pressurize/depressurize bulk containers and produce flows of concentrated fluids and/or provide compressed air for other functions in a blending unit (e.g., blending unit 116' as shown in FIG. 11) or other units found on blending platform 104.

In certain embodiments, process air system 202 includes air generation unit 300. Air generation unit 300 may include compressor 301 and associated components for producing compressed air. In some embodiments, air generation unit 300 includes a connection for coupling backup compressor 301' to the air generation unit. As shown in FIG. 12, air generation unit 300 provides compressed air to manifold 302. Manifold 302 may distribute compressed air to various systems on the blending platform.

In certain embodiments, manifold 302 provides compressed air to header 142, vent 203, and vent line(s) 205. Vent 203 may provide compressed air to a scrubber system (e.g., scrubber system 160''' shown in FIG. 21). In some embodiments, manifold 302 provides compressed air to header 142' and vent 203', which may be used to handle a fluid with different chemistry than the fluid being handled by header 142 and vent 203. In certain embodiments, manifold 302 provides compressed air to various air operated systems throughout the blending unit using manifolds 304A, 304B, and/or 304C. Such air operated systems may include, but not be limited to, pumps and valves. In some embodiments, compressed air is provided to a containments system (e.g., containment system 120) for use in pumps or valves in the containment system. In some embodiments, compressed air is routed back to compressed air system 202 at 304' to be used for operation of valves in manifold 302

Figure 15:
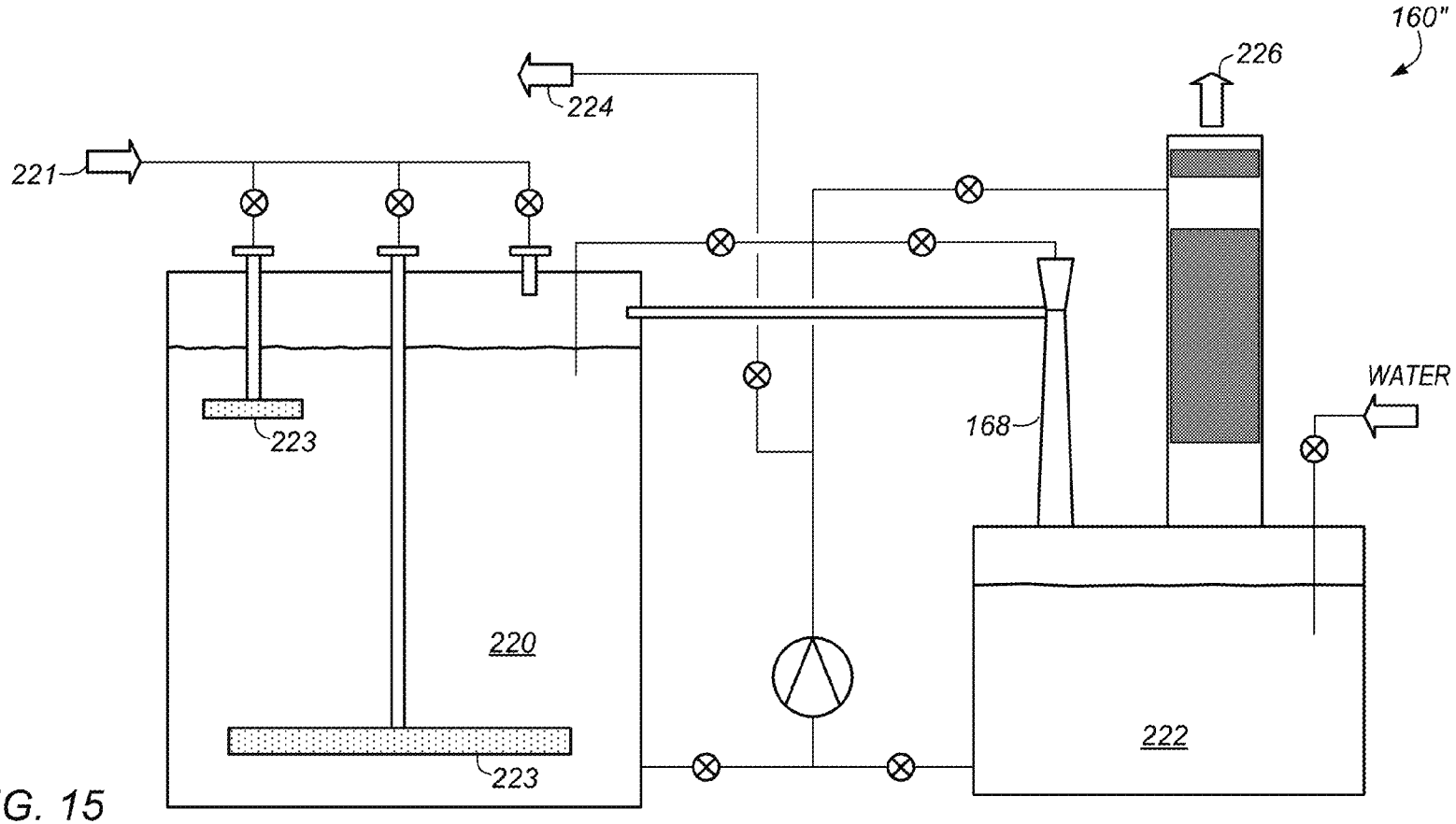
FIG. 15 depicts a schematic of yet another embodiment of a scrubber system that may be used in a blending scheme.

FIG. 15 depicts a schematic of another embodiment of a scrubber system. Scrubber system 160" may be used in, for example, blending scheme 200' or any other blending scheme disclosed herein. Scrubber system 160" may include collection tank 220 and venturi scrubber package 222. Collection tank 220 may be, for example, an isotainer depressurization knock-out scrubber tank. In certain embodiments, collection tank 220 receives fluids from vents or vent lines in a blending system (e.g., vent 203 and/or vent lines 205A-D in blending scheme 200') at vent inlets 221. In some embodiments, one or more vent inlets 221 include diffusers 223 inside collection tank 220.

Fluids from collection tank 220 may be recovered and sent back to bulk containers at 224 and/or sent to venturi scrubber package 222. In some embodiments, fluids sent to venturi scrubber package 222 are introduced through eductor 168. Venturi scrubber package 222 may scrub fluids and send recovered fluids (e.g., recovered concentrated fluids such as acid) back to bulk containers at 224 and/or vent fluids at 226. In certain embodiments, fluids vented at 226 only include fluids with little or no emission protocols (e.g., water).

Figure 13:
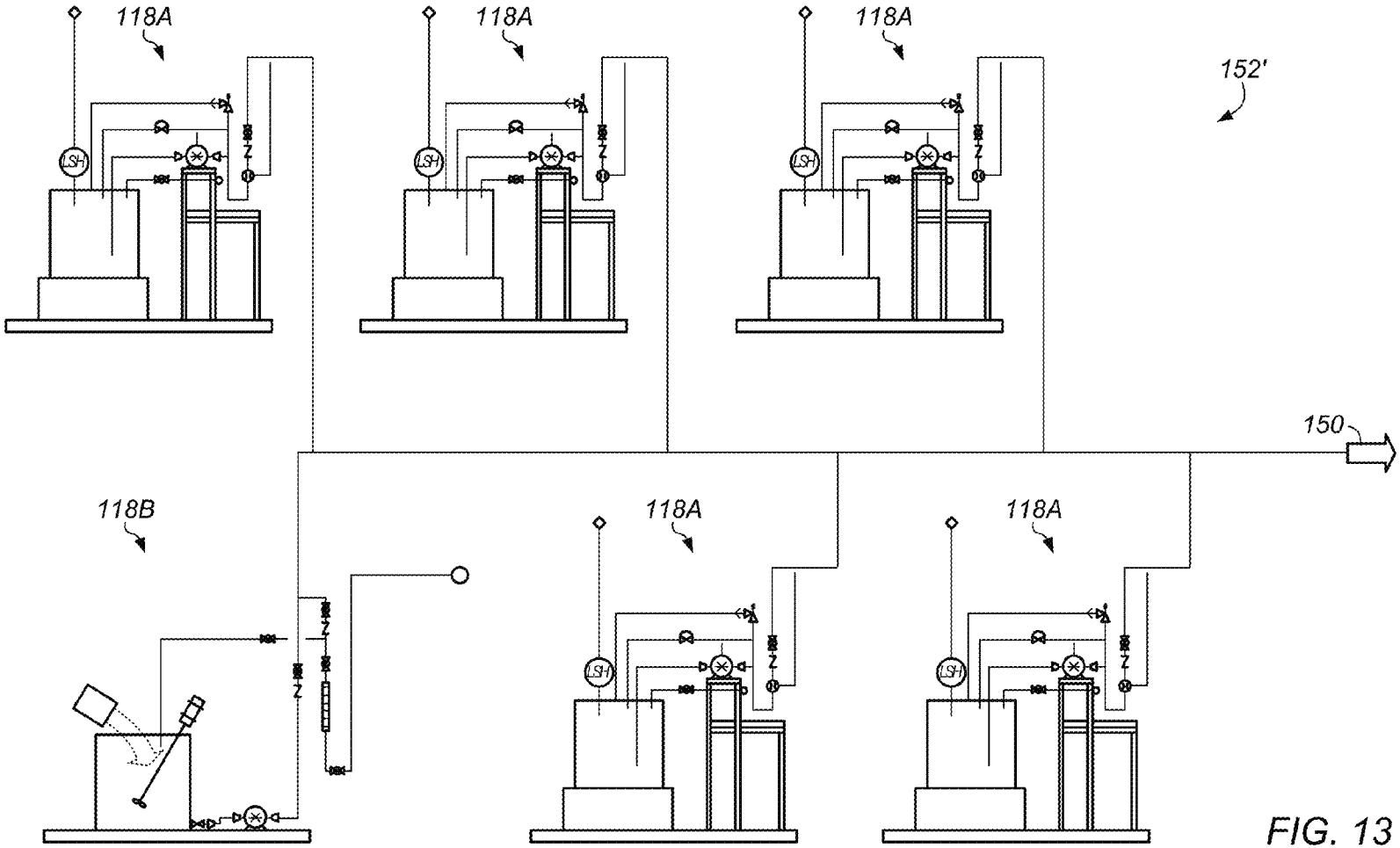
FIG. 13 depicts a schematic of an embodiment of an additive section with liquid containers and a dry container.

FIG. 13 depicts a schematic of an embodiment of additive section 152' with liquid containers 118A and dry container 118B. Water or other fluids may be added to dry container 118B to produce a deliverable liquid for one or more dry additives provided into the dry container. Additives may be provided to produce final desired fluids (e.g., fracking fluids) for use at the process site. Containers 118A, 118B, and/or the additive line may include devices (e.g., flowmeters and/or telemetry) to monitor the amount of each additive being provided to blend header 150. As the additives may be either in liquid or dry form, various types of metering, measuring, and/or conveyance systems may be coupled between containers 118A, 118B, and header 150.

Figure 14:
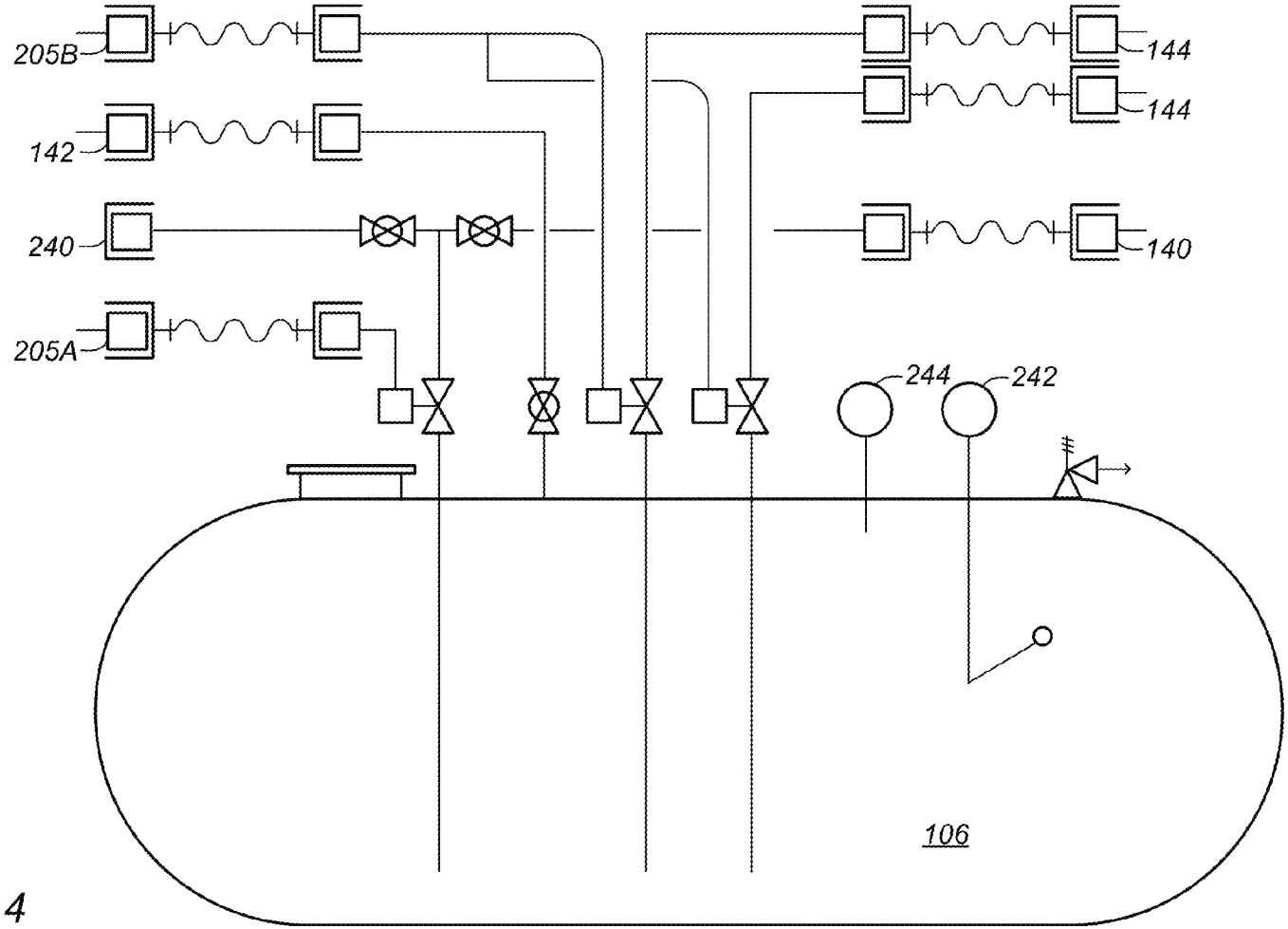
FIG. 14 depicts a schematic of an embodiment of a bulk container.

FIG. 14 depicts a schematic of an embodiment of bulk container 106. As shown in FIG. 14, bulk container 106 is provided with various connectors and couplings to allow the bulk container to provide and receive fluids as needed. In certain embodiments, bulk container 106 includes connections for coupling to header 140, header 142, header 144, and vent lines 205A-B. In some embodiments, bulk container 106 includes connection 240 for coupling to a tanker truck (e.g., a chemical tanker truck used to fill the bulk container). In certain embodiments, vent line 205A includes venting for filling bulk container 106 through header 140 and/or connection 240. In some embodiments, vent line 205B is used to depressurize bulk containers 106.

In certain embodiments, bulk container 106 includes various devices (e.g., flowmeters and/or telemetry sensors) to monitor the flow of fluids into/out of the bulk container and/or to monitor the status of fluids inside the bulk container. For example, bulk container 106 may include level indicator 242 and level switch 244.

Figure 16:
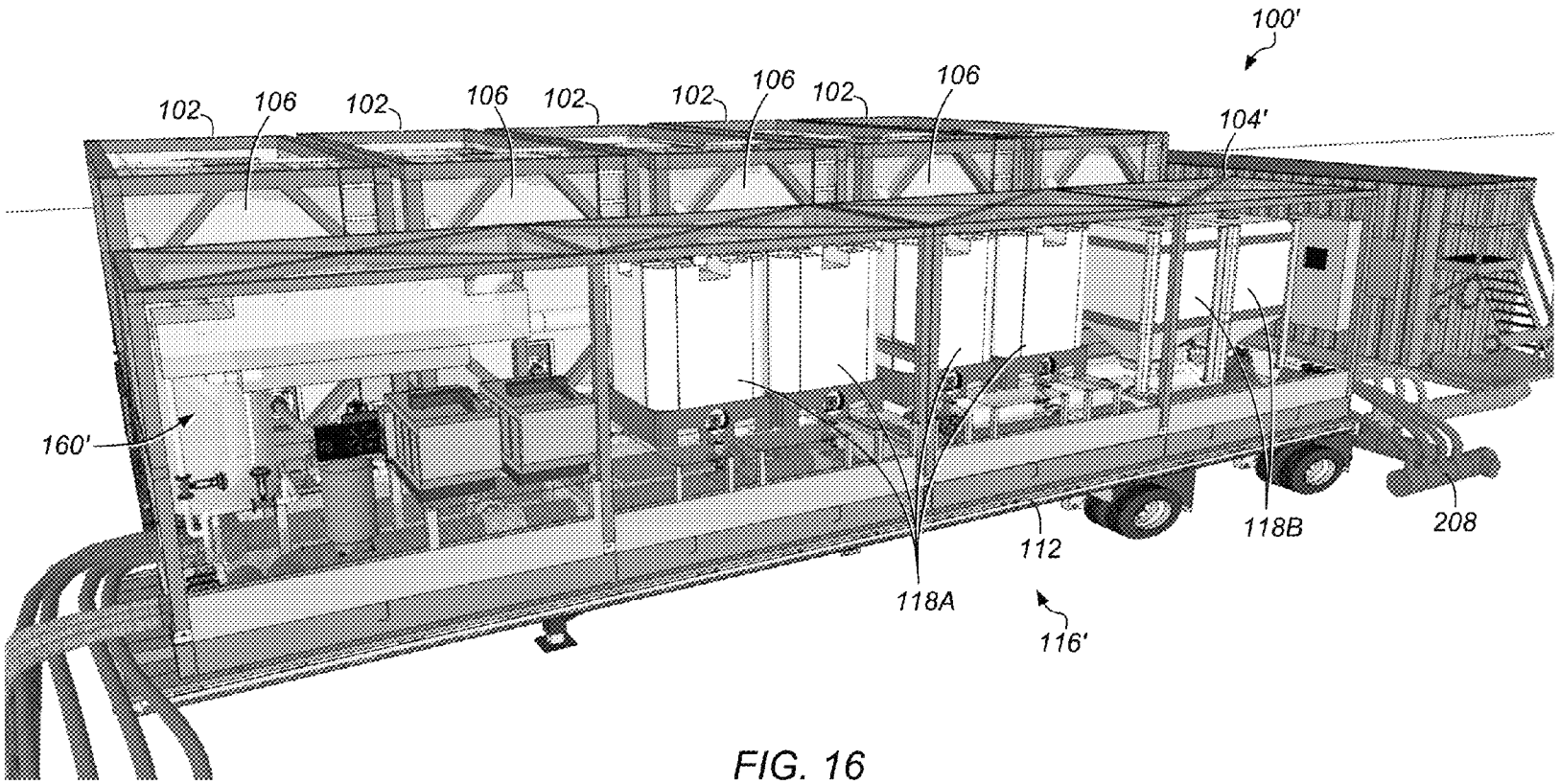
FIG. 16 depicts a representation of an embodiment of a blending system that includes tank platforms and a blending platform.
Figure 17:
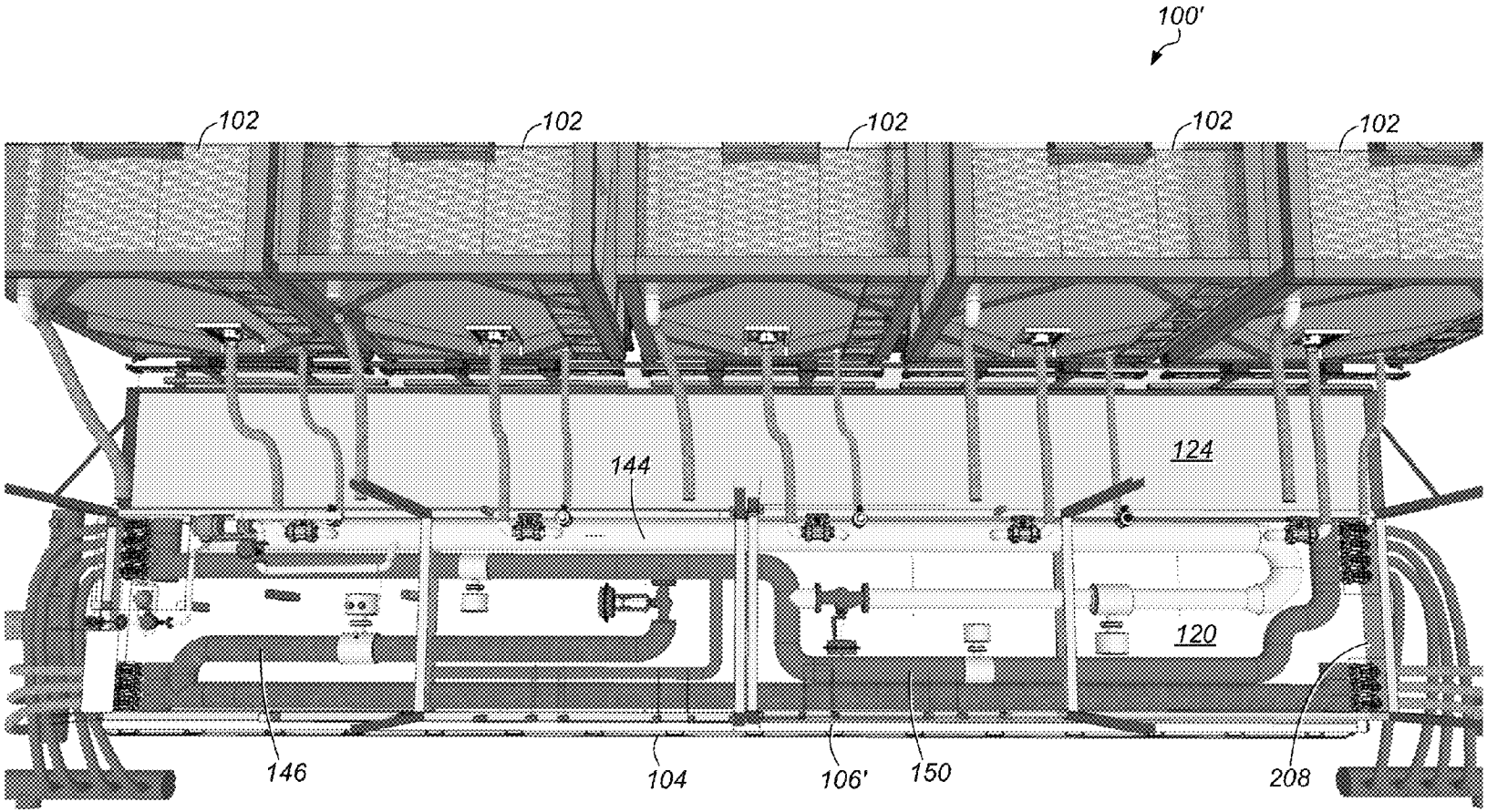
FIG. 17 depicts a top view of an embodiment of a blending platform coupled to tank platforms.
Figure 18:
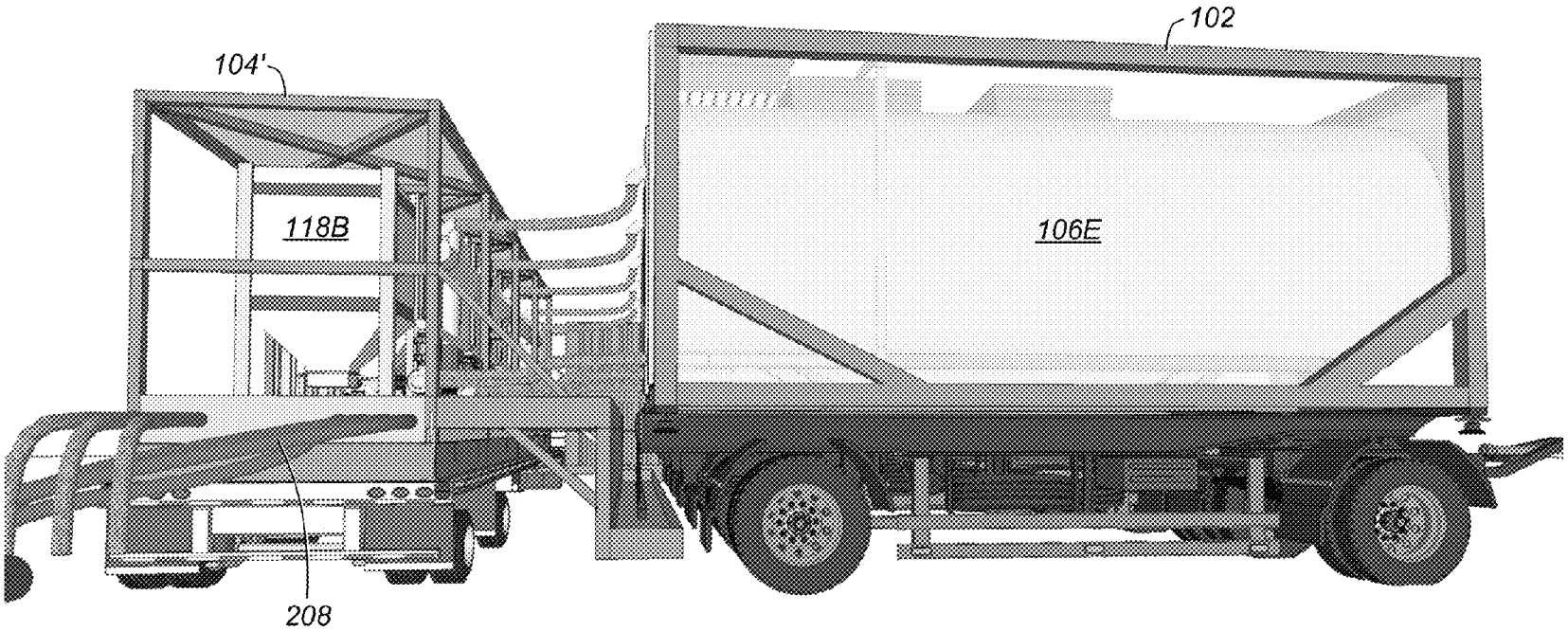
FIG. 18 depicts a side view of an embodiment of a blending platform coupled to tank platforms.

FIG. 16 depicts a representation of an embodiment of blending system 100' that includes tank platforms 102 and blending platform 104'. FIG. 17 depicts a top view of an embodiment of blending platform 104' coupled to tank platforms 102. FIG. 18 depicts a side view of an embodiment of blending platform 104' coupled to tank platforms 102. Tank platforms may include one or more bulk containers 106. Blending platform 104' may be placed on trailer 112. In certain embodiments, blending platform 104' includes blending unit 116', sub-blending system 206, and scrubber system 160' that may be used in, for example, blending scheme 200' or any other blending scheme disclosed herein.

In certain embodiments, blending platform 104' is placed on trailer 112. In certain embodiments, blending platform 104' includes one or more containers 118A, 118B. As shown in FIG. 16, blending platform 104' includes four liquid containers 118A and four dry containers 118B. As shown in FIG. 17, blending platform 104' may include containment system 120 and be coupled to secondary containment 124. As shown in FIG. 16-18, product fluids are output from blending platform 104' at or near the bottom of the blending platform (e.g., product header 208 is at or near the bottom of the blending platform). In some embodiments, however, product header 208 is at the top or near the top of blending platform 104'.

Figure 19:
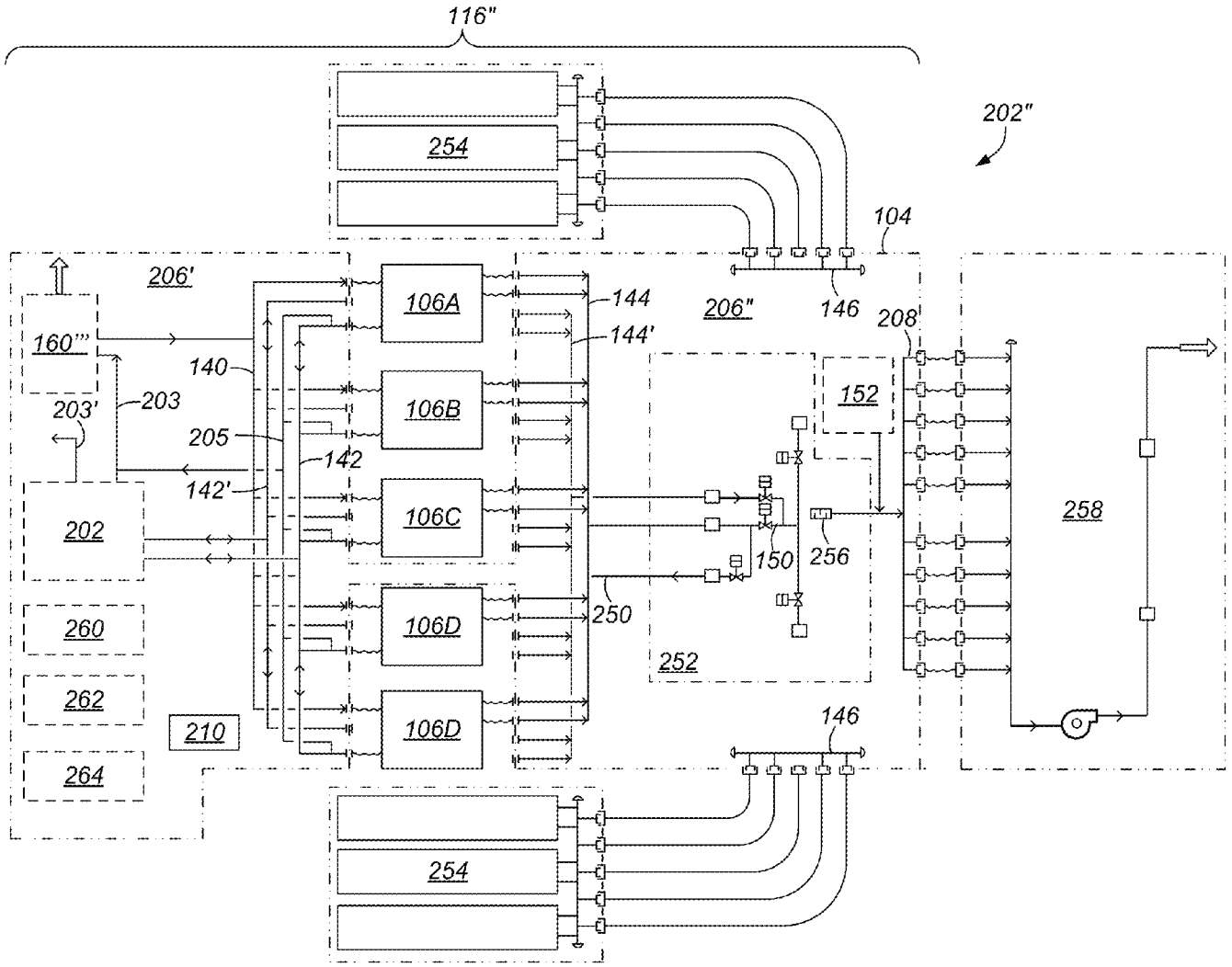
FIG. 19 depicts yet another embodiment of a blending scheme.

FIG. 19 depicts yet another embodiment of a blending scheme. Blending scheme 200" may include blending unit 116". Blending unit 116" may be located on blending platform 104, blending platform 104', or another suitable blending platform. For example, as shown in FIG. 19, blending unit 116" may include sub-blending system 206' and sub-blending system 206" and the blending systems may be located on blending platform 104 (represented by dashed lines). Bulk containers 106 may be located on their own tank platforms (e.g., tank platforms 102).

In certain embodiments, blending unit 116" includes headers 140, 142, 144 coupled to each of bulk containers 106A-E through corresponding valves on each header. In some embodiments, header 140 is a fill header coupled to bulk containers 106. Header 140 may be coupled to bulk containers 106 through, for example, valves. Header 140, as shown in FIG. 19, may be coupled to scrubber system 160'" to fill bulk containers 106 with fluids recovered using the scrubber system (e.g., concentrated fluids such as acid recovered by the scrubber system).

In certain embodiments, header 142 is a small diameter header (e.g., a 2" or 3" header) or other header suitable for flow of compressed air or another gas. In certain embodiments, header 142 is coupled to process air system 202. Process air system 202 and header 142 may be used to provide compressed air (or another suitable fluid) to pressurize bulk containers 106. Pressurizing bulk containers 106 may increase the flow of fluids (e.g., concentrated fluids such as acid) from the bulk containers. In some embodiments, process air system 202 and header 142 are used to depressurize bulk containers 106, as desired.

Depressurizing bulk containers 106 may decrease the flow of fluids from the bulk containers. In some embodiments, vent line 205 may be used during depressurization of bulk containers 106 with vapors vented to scrubber system 160'" through the vent line (and vent 203). During depressurization of bulk containers 106, vented air/fluid vapors may be sent to scrubber system 160'" from using vent 203. Vent 203 may include vapors from process air system 202 and/or vent line 205.

In certain embodiments, the flow of compressed air from process air system 202 is controlled to control the pressure in one or more of bulk containers 106. Controlling the flow of compressed air into bulk containers 106 may control the flow rate of fluids (e.g., acid) from the bulk containers. In some embodiments, the flow of compressed air is controlled to different combinations of bulk containers 106. For example, a first flow of compressed air may be provided to one set of bulk containers while a second flow of compressed air (controlled separately from the first flow) is provided to another set of bulk containers. In some embodiments, the flow of compressed air to bulk containers 106 is individually controlled (e.g., the flow into each bulk container is individually controlled and can have a different flow). Thus, the flow or flow rate of fluid out of bulk containers 106 may be controlled as two (or more) flows for two (or more) sets of bulk containers or, the flow or flow rate may be individually controlled for individual bulk containers.

In certain embodiments, the flow of compressed air from process air system 202 is at most about 15 psig. Using a pressure below about 15 psig allows the use of low pressure equipment, reduces the likelihood of fluids leaks (e.g., acid leaks), and reduces other potential problems such as mechanical problems or equipment failure that may be caused by using higher pressure systems. The use of air pressure to provide fluid (e.g., acid) flow through blending unit 116" (or any other blending unit described herein) reduces or removes horsepower requirements for blending scheme 200" (or any other blending scheme described herein). Horsepower requirements are reduced as using compressed air reduces or eliminates the need for pumps to move fluid from the bulk containers and through the blending system.

In some embodiments, header 250 is used to transfer materials between bulk containers 106, as needed. For example, fluid from header 144 may be moved into header 250, which transfers the fluid to header 140. Header 140 may then be used to fill bulk containers 106 with the fluid as desired.

In some embodiments, header 142' and header 144' are used in addition to header 142 and header 144. Header 142' and header 144' may be substantially similar headers coupled to bulk containers 106. Header 142' and header 144' may be used, for example, to handle a fluid with different chemistry than the fluid being handled by header 142 and header 144 (e.g., header 142' and header 144' may handle a different chemistry fluid stored in one of bulk containers 106). Thus, the use of header 142' and header 144' blending unit 116" to handle multiple fluid chemistries substantially simultaneously. Process air system 202 may provide similar pressure compressed air or compressed air at a different pressure to header 142' (as compared to header 142). For example, in some embodiments, process air system 202 individually controls air pressures to header 142 and header 142' to provide varying flows of the fluids with different chemistries.

In certain embodiments, one or more additional vent lines (not shown) are located in blending unit 116' to capture fumes, vapors, or other fluids from one or more locations in bulk containers 106 and the blending unit. The vent lines may provide the captured fluids to scrubber system 160'".

In certain embodiments, header 144, and/or header 144' is used to provide fluids from bulk containers 106 to sub-blending system 206". Sub-blending system 206" may include chemical dilution unit 252. In unit 252, fluids in header 144 and/or header 144' may be combined in header 150. Header 150 may be, for example, a blend header. In certain embodiments, fluids in header 150 are diluted with water from water header(s) 146. Water may be provided from water tanks (e.g., tanks 254) or another suitable water source provided by a customer and coupled to blending platform 104 at water header(s) 146. Flowmeters and/or other data collection devices may be used to monitor dilution of fluids in header 150.

After dilution of fluids in header 150, additives may be provided to the diluted fluids from additive section 152'. In some embodiments, fluids in header 150 flow through mixer 256 (e.g., an inline mixer) before additives are added to the diluted fluids. Following the addition of additives, the final product fluids may be provided to product header 208. Product header 208 may be coupled hoses or other hook-ups that allow the customer to provide the fluids to customer process 258. Customer process 258 may be, for example, a treatment site (e.g., a subsurface process site for fracking or another subsurface process) or another customer operated blending process.

In some embodiments, blending unit 116" includes process water system 260, safety water system 262, power system 264, and/or other systems needed to operate and/or ensure the safety of the blending process. In some embodiments, power system 264 includes a hydraulic operating system. In certain embodiments, blending unit 116" includes controller 210 to provide communication and software controls to implement a real-time blending process using the blending unit.

Figure 20:
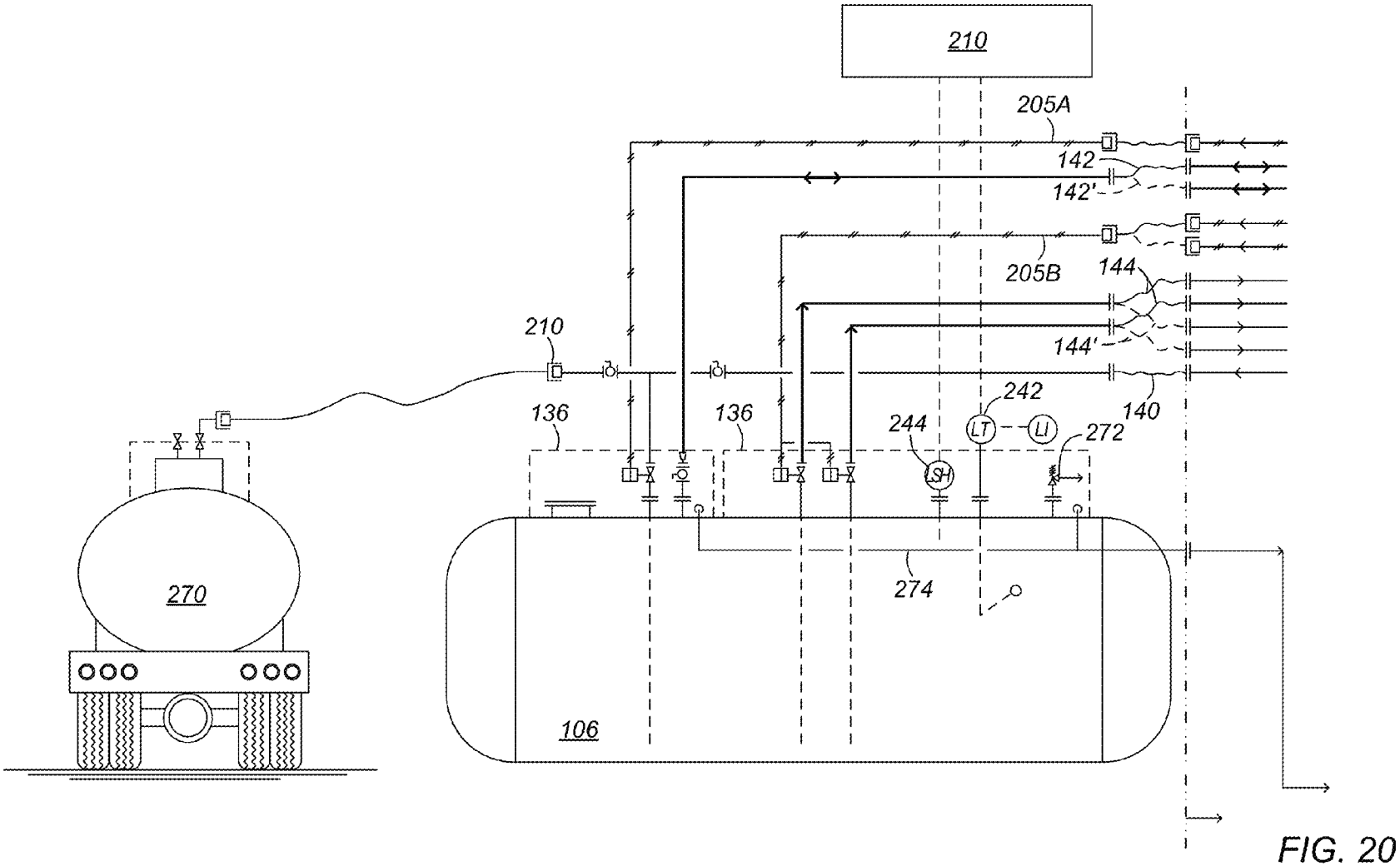
FIG. 20 depicts a schematic of another embodiment of a bulk container.

FIG. 20 depicts a schematic of another embodiment of bulk container 106. In certain embodiments, bulk container 106 includes connections for coupling to header 140, header 142, header 142', header 144, header 144', and vent lines 205A-B. In certain embodiments, bulk container 106 includes two connections (e.g., outlets) to header 144 and/or header 144'. Using two (or more outlets) from bulk container 106 to downstream headers may lower pressures to be used to provide suitable flow rates for the blending system.

In some embodiments, bulk container 106 includes connection 240 for coupling to tanker truck 270. Tanker truck 270 may be, for example, a chemical tanker truck used to provide acid or another concentrated fluid. In certain embodiments, vent line 205A includes venting for filling of bulk container 106 through header 140 and/or connection 240. In some embodiments, vent line 205B is used to depressurize bulk containers 106 and/or as venting for fluid leaving bulk container 106 to header 144 and/or header 144'.

In certain embodiments, bulk container 106 includes level indicator 242 and level switch 244. Level indicator 242 may provide real-time assessment of fluid level in bulk container 106. In some embodiments, bulk container includes pressure safety valve 272. In some embodiments, containment 136 is provided around connections to bulk container 106. Drain line 274 may be coupled to containment 136. Drain line 274 may transfer fluids from containment 136 to another containment system (e.g., containment system 120) or a waste disposal unit.

Figure 21:
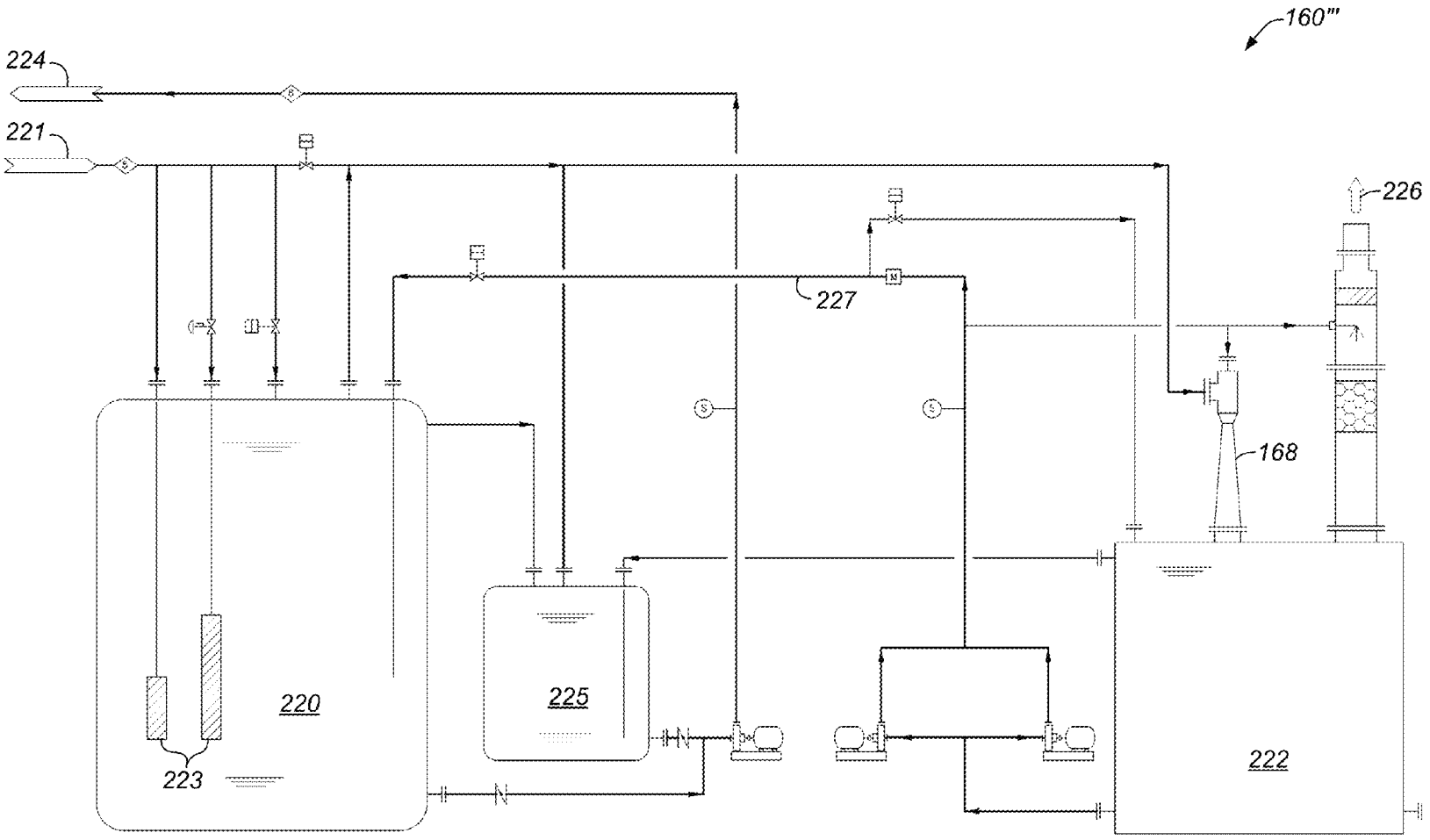
FIG. 21 depicts a schematic of yet another embodiment of a scrubber system.

FIG. 21 depicts a schematic of yet another embodiment of a scrubber system. Scrubber system 160''' may be used in, for example, blending scheme 200" or any other blending scheme disclosed herein. Scrubber system 160''' may be substantially similar to scrubber system 160" (shown in FIG. 15) except for the inclusion of recovery tank 225. Recovery tank 225 may be used to receive collected and/or condensed vapors from collection tank 220, vent inlets 221, and/or venturi scrubber package 222. For example, recovery tank 225 may receive overflow vapors from collection tank 220 and/or venturi scrubber package 222. In certain embodiments, outlet from recovery tank 225 is combined with outlet from collection tank 220 before being provided back to bulk containers at 224.

In certain embodiments, fluids sent to venturi scrubber package 222 are introduced through eductor 168. Venturi scrubber package 222 may then scrub fluids, condense the scrubbed fluids, and send the condensed fluids (e.g., recovered concentrated fluids such as acid) back to collection tank 220 through header 227. In certain embodiments, fluids vented at 226 only include fluids with little or no emission protocols (e.g., water). In certain embodiments, scrubber system 160''' provides abatement (e.g., containment and recovery) of at least about 90% of vapors released on the blending platform.

Figure 22:
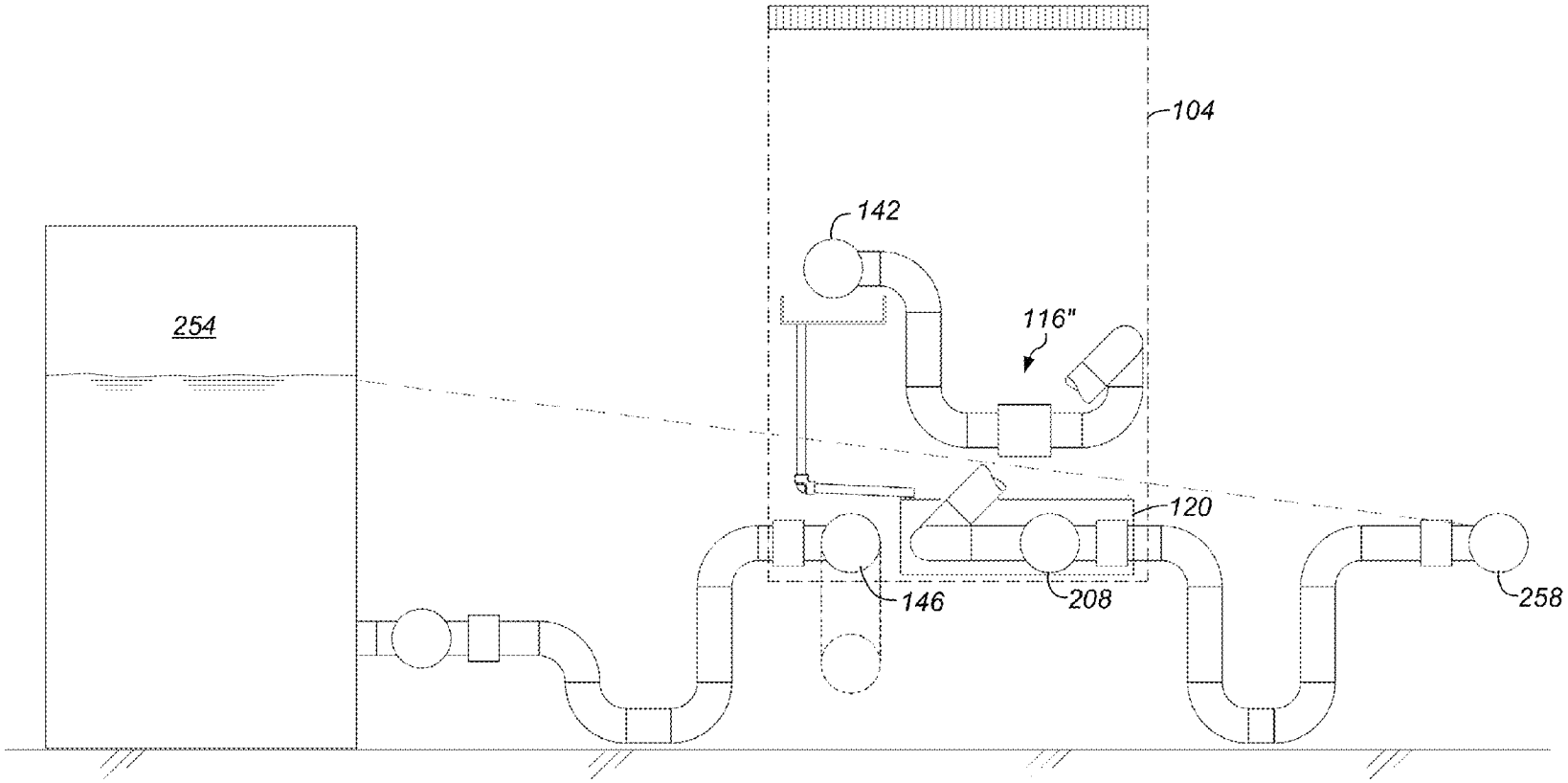
FIG. 22 depicts a side-view representation of an embodiment of a blending unit on a blending platform coupled to a tank and a customer process.

FIG. 22 depicts a side-view representation of an embodiment of blending unit 116" on blending platform 104 coupled to tank 254 and customer process 258. Tank 254 may be coupled to blending platform 104 at header 146. Customer process 258 may be coupled to blending platform 104 at process header 208 of blending unit 116". Process header 208 may be located in containment system 120. In certain embodiments, as shown in FIG. 22, the water level in tank 254 is above a connection point for customer process 258.

Figure 23:
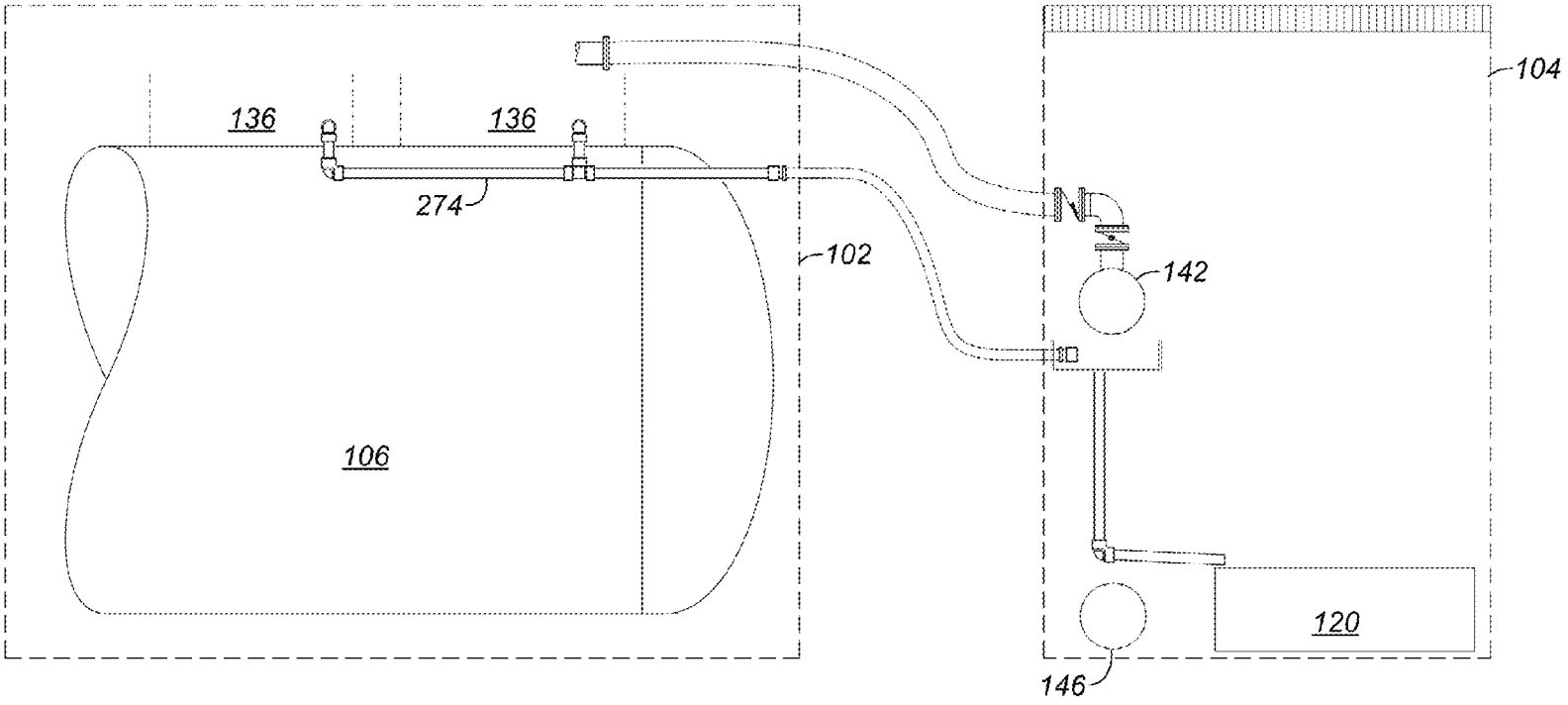
FIG. 23 depicts a side-view representation of an embodiment of a bulk container on a tank platform coupled to a header on a blending platform.

FIG. 23 depicts a side-view representation of an embodiment of bulk container 106 on tank platform 102 coupled to header 142 on blending platform 104. As shown in FIG. 23, drain line 274 couples containment 136 (e.g., spill boxes) on tank platform 102 to containment system 120 on blending platform 104. Containment 136 may be positioned above containment system 120 to allow gravity drainage of fluid between the systems.

Figure 24:
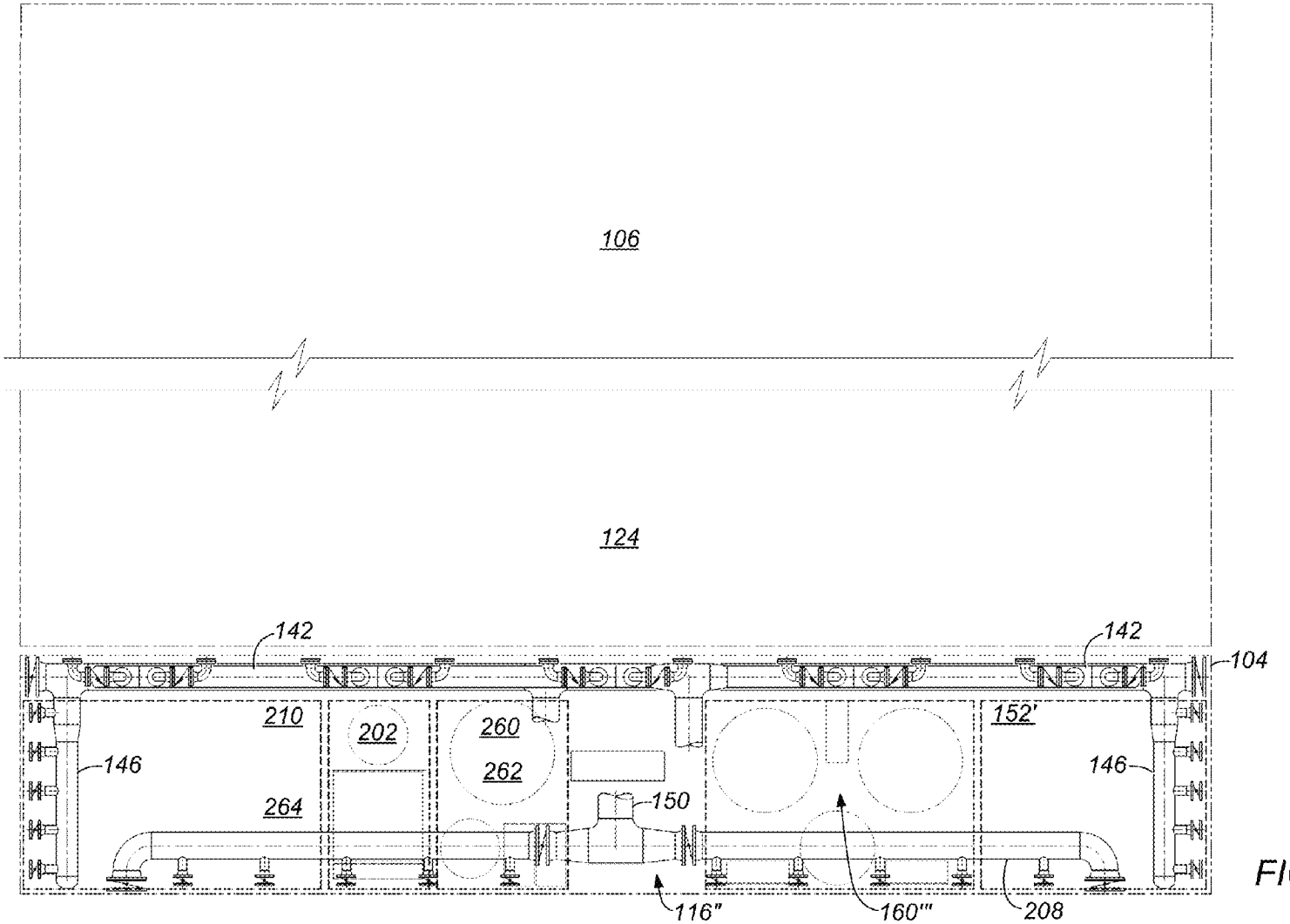
FIG. 24 depicts a top-view representation of an embodiment of bulk containers on tank platform(s) coupled to a blending unit on a blending platform.

FIG. 24 depicts a top-view representation of an embodiment of bulk containers 106 on tank platform(s) 102 coupled to blending unit 116" on blending platform 104. In certain embodiments, secondary containment 124 is located between bulk containers 106 and on blending platform 104. Connections for header 142 may be positioned on a side of on blending platform 104 closest to bulk containers 106 while connections for water header(s) 146 are positioned on opposing sides of the blending platform. Connections for process header 208 may be positioned opposite connections for header 142.

As shown in FIG. 24, controller 210 and power system 264 may be combined and positioned at one end of blending platform 104. Process air system 202 may be adjacent controller 210 and power system 264. Process water 260 and safety water 262 may be adjacent process air system 202. Scrubber system 160''' may be opposite header 150 from process water 260 and safety water 262, and additive section 152' may be adjacent the scrubber system. While such locations of systems are shown in FIG. 24, it is to be understood that these locations are merely presented as an example and that any variation of locations is possible.

As shown in FIGS. 11-24, blending units, sub-blending systems, scrubber systems, and other systems described herein may include various valves, pumps, flowmeters, telemetry sensors, and other equipment suitable to operate a blending scheme run by a blending system. In certain embodiments, a blending scheme (e.g., blending scheme 200' or blending scheme 200") includes a controller to implement and control a real-time, substantially continuous, blending process. For example, controller 210, shown in FIGS. 11 and 19, may be used to implement and control the blending process. Blending scheme 200, shown in FIG. 6, may include a similar controller. Controller 210 may be located on blending platform 104 or other blending platforms described herein.

In certain embodiments, controller 210 includes communication and software controls to implement and control the real-time, substantially continuous, blending process. For example, controller 210 may implement and control the blending process to produce desired fluids (e.g., fracking fluids) on a substantially continuous basis as needed by the customer. For example, controller 210 may implement and control the blending process to produce desired fluids at a continuous flow rate needed by the customer. In certain embodiments, controller 210 implements and controls the blending process to provide continuous flow rates of desired fluids at flow rates of up to about 2500 gallons/minute. The blending process may be monitored and adjusted in real-time by controller 210 to provide fluids with desired properties to the customer. Thus, controller 210 may provide desired fluids on an on-demand basis to the customer.

Measurement devices such as flowmeters and/or other data collection devices (e.g., telemetry devices, tank level indicators, valve position indicators, etc.) are in communication with controller 210 for the blending process. Controller 210 may be, for example, a programmable logic controller (PLC) or other suitable process controller. Communication may be achieved using either wired or wireless communication systems (e.g., either hardwiring or cellular/satellite communication). Communication with the controller may allow data to be shared with operators, users, clients, and/or customers either on-site or remotely. Communication with controller 210 allows accessibility to the controller for programming, reporting, diagnostic, and/or troubleshooting functions.

In certain embodiments, controller 210 collects data from the measurement devices and processes the data to adjust flow rates of each of the fluids (e.g., flow of acid, water, or additives) to provide a product with desired characteristics (e.g., desired dilution and additive levels). For example, controller 210 may collect flow rates from the flowmeters and adjust the flow of one or more of the fluids (e.g., acids or water) if any conditions change in the flow rates and/or a condition changes in the final product fluid. In some embodiments, the flow rates of fluids (e.g., acids) are controlled by controlling the flow of compressed air into bulk containers and/or the pressure in the bulk containers. Controller 210 may adjust the flow of one or more of the fluids via communication with valves controlling the flow of the fluids. The valves may provide position data to controller 210 and vice versa to allow for control of fluid flow in blending scheme 200' including, but not limited to, blending units, sub-blending systems, and scrubber systems.

In some embodiments, blending platform 104 provides product fluids to a process at a process site (e.g., fracking fluids provided into the subsurface at a fracking site) with one or more substantially constant product fluid properties. For example, the product fluids may be provided with a substantially constant acid percentage (e.g., the product fluid is about 15% by volume acid in water and additives). In some embodiments, controller 210 provides fluids with varying properties based on the demands of the customer. For example, the customer may desire fluids with a first set of selected properties for a first time period and a second set of selected properties for a second time period.

In certain embodiments, blending platform 104 provides product fluids to the process site with one or more product fluid properties varying over time. For example, in some embodiments, blending platform 104 provides a product fluid to the process site with an acid percentage that varies over time (e.g., the acid is provided to the process site at a variable rate). The acid percentage may vary over time using a selected variation profile. For example, the acid percentage may vary with a sinusoidal profile (the acid percentage follows a sine wave curve) or a square wave profile. The selected variation profile for the acid percentage may be selected by a user of blending platform 104 and/or other inputs provided into the real-time blending process. For example, the selected variation profile may be determined by the controller (e.g., the PLC controller) based on one or more inputs provided by a user in combination with data collected by the controller from blending platform 104 (e.g., data from measurement devices on the blending platform).

As an example, the user may select an average acid percentage for the product fluids, a selected variation profile, minimum and maximum acid percentages, and/or time periods for above average and below average acid percentages. The controller may then use this information to provide product fluids with the desired outputs. The controller may also monitor (assess) properties of the product fluids using measurement devices on blending platform and adjust properties of the product fluids as needed.

Varying the acid percentage over time allows a higher acid percentage to be provided during certain desired time periods and a lower acid percentage to be provided during other desired time periods. For example, an acid percentage with a sinusoidal profile may be provided with the average acid percentage being about 15% by volume acid. As further example, the sinusoidal profile may vary between an upper acid percentage of about 25% by volume acid and a lower acid percentage of about 5% by volume acid with periods above and below the average acid percentage being about 5 minutes. In a subsurface formation, providing the higher acid percentage may be used for increasing reactions in the formation while the lower acid percentage may be used for washing out reaction products from the formation. Varying the acid percentage (or other product fluid properties) over time using the selected variation profile may provide a more efficient use of product fluids in the subsurface formation or for other uses of blending platform 104.

In some embodiments, product data for the final product is sampled in real-time. The controller may use the real-time product data and makes adjustments in response to the sampled product data. Examples of final product data that may be collected include, but are not limited to, pH level, conductivity, and density.

In certain embodiments, the controller allows input of desired formulations for the final product into the controller. Desired formulations may be input on-site or remotely using communication systems (e.g., cellular or satellite communication). Desired formulations may be input manually or automatically based on desired needs.

In certain embodiments, the controller provides usage data for fluids in the blending system. For example, the controller may provide a report of how much fluid from one or more of the bulk containers is used and/or how much fluid from the additive containers is used. These reports may be used by the controller or another system to provide invoicing for chemical usage. These reports may also be used to track inventory and/or provide alerts for when chemical resupply is needed (e.g., another bulk container is needed on-site). Thus, the controller may be used to provide invoicing services and/or inventory management control.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a valve" includes a combination of two or more valves and reference to "a fluid" includes mixtures of fluids.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A continuous, real-time blending process, comprising:

providing a flow of at least two concentrated fluids from at least two bulk containers, wherein the concentrated fluids are stored in the bulk containers;

combining the flows of two or more concentrated fluids from the bulk containers;

continuously blending the combined flow of the two or more concentrated fluids with water to produce a desired fluid comprising the concentrated fluids and the water;

receiving inputs from a user, at least a first input comprising a minimum value for a concentration of the at least one concentrated fluid in the desired fluid for a selected time period, at least a second input comprising a maximum value for the concentration of the at least one concentrated fluid in the desired fluid over the selected time period;

continuously providing the desired fluid to a well in a subsurface of the earth for a selected time period; and automatically controlling the flow of the concentrated fluids and the water to vary the concentration of at least one concentrated fluid in the desired fluid over the selected time period based on the inputs received from the user, wherein the concentration of the at least one concentrated fluid in the desired fluid is varied between the received minimum value for the concentration and the received maximum value for the concentration over the selected time period, the concentration being varied to have a first concentration value for at least some time during the selected time period and a second concentration value for at least some time during the selected time period, the first concentration value and the second concentration value being determined based on the inputs received from the user, and wherein the first concentration value is different than the second concentration value.

2. The process of claim 1, wherein at least one input comprises an average value of the concentration between the minimum value and the maximum value of the concentration, the concentration of the at least one concentrated fluid in the desired fluid being controlled to have the average value of the concentration between the minimum value and the maximum value of the concentration, and wherein the first concentration value is above the average value of the concentration and the second concentration value is below the average value of the concentration.

3. The process of claim 1, further comprising assessing one or more properties of the produced desired fluid, and controlling the concentration of the at least one concentrated fluid in the desired fluid in response to the assessed properties of the produced desired fluid.

4. The process of claim 1, further comprising assessing flow rates of the concentrated fluids and water, and determining the concentration of the at least one concentrated fluid in the desired fluid based on the inputs received from the user in combination with the assessed flow rates of concentrated fluids and water.

5. The process of claim 1, wherein the concentration of the at least one concentrated fluid in the desired fluid is controlled to vary with a non-linear concentration versus time profile over the selected time period.

6. The process of claim 1, wherein the concentration of the at least one concentrated fluid in the desired fluid is controlled to vary with a sinusoidal concentration versus time profile over the selected time period.

7. A continuous, real-time blending process, comprising:

providing a flow of at least two concentrated fluids from at least two bulk containers, wherein the concentrated fluids are stored in the bulk containers;

combining the flows of two or more concentrated fluids from the bulk containers;

continuously blending the combined flow of the two or more concentrated fluids with water to produce a desired fluid comprising the concentrated fluids and the water;

continuously providing the desired fluid to a well in a subsurface of the earth for a selected time period;

automatically varying the flow of the concentrated fluids and the water to provide the desired fluid with a concentration of at least one concentrated fluid in the desired fluid that varies over the selected time period with a selected variation profile, wherein the selected variation profile has an average value of the concentration of the at least one concentrated fluid in the desired fluid, and wherein the concentration of the at least one concentrated fluid in the desired fluid varies both above and below the average value for at least some time during the selected time period; and determining the selected variation profile based on a plurality of inputs provided by a user, wherein at least one input provided by the user comprises the average value of the concentration of the at least one concentrated fluid in the desired fluid, at least one input provided by the user comprises at least a first time period for the concentration to be below the average value of the concentration, and at least input provided by the user comprises at least a second time period for the concentration to be above the average value of the concentration.

8. The process of claim 7, further comprising assessing one or more properties of the produced desired fluid, and controlling the concentration of the at least one concentrated fluid in the desired fluid in response to the assessed properties of the produced desired fluid.

9. The process of claim 7, further comprising assessing flow rates of the concentrated fluids and water, and determining the concentration of the at least one concentrated fluid in the desired fluid based on the inputs provided by the user in combination with the assessed flow rates of concentrated fluids and water.

10. The process of claim 7, wherein the concentration of the at least one concentrated fluid in the desired fluid is controlled to vary with a non-linear concentration versus time profile over the selected time period.

11. The process of claim 1, wherein at least one input received from the user comprises a concentration versus time profile for varying the concentration of the at least one concentrated fluid over the selected time period.

12. The process of claim 2, wherein at least one input received from the user comprises at least a first time period for the concentration to be below the average value of the concentration, and wherein at least one input received from the user comprises at least a second time period for the concentration to be above the average value of the concentration.

13. The process of claim 7, wherein at least one input provided by the user comprises a minimum concentration of the at least one concentrated fluid during the selected time period.

14. The process of claim 7, wherein at least one input provided by the user comprises a maximum concentration of the at least one concentrated fluid during the selected time period.

15. The process of claim 7, wherein at least one input provided by the user comprises a concentration versus time profile for the selected variation profile over the selected time period.

16. The process of claim 15, wherein the input concentration versus time profile for the selected variation profile comprises a sinusoidal concentration versus time profile.

17. A continuous, real-time blending process, comprising:

providing a flow of at least two concentrated fluids from at least two bulk containers, wherein the concentrated fluids are stored in the bulk containers;

combining the flows of two or more concentrated fluids from the bulk containers;

continuously blending the combined flow of the two or more concentrated fluids with water to produce a desired fluid comprising the concentrated fluids and the water;

receiving inputs from a user, at least one received input comprising an average value of a concentration of at least one concentrated fluid in the desired fluid, at least one received input comprising at least a first time period for the concentration to be below the average value of the concentration, and at least one received input comprising at least a second time period for the concentration to be above the average value of the concentration;

determining a selected variation profile for the concentration of the at least one concentrated fluid in the desired fluid based on the inputs received from the user, wherein the selected variation profile comprises varying the concentration of the at least one concentrated fluid in the desired fluid both above and below the average value such that the concentration is below the average value of the concentration for at least the first time period and above the average value of the concentration for at least the second time period;

continuously providing the desired fluid to a well in a subsurface of the earth for a selected time period; and automatically varying the flow of the concentrated fluids and the water to provide the desired fluid with the concentration of the at least one concentrated fluid in the desired fluid that varies over the selected time period with the selected variation profile.

18. The process of claim 17, wherein at least one input received from the user comprises a concentration versus time profile for the selected variation profile over the selected time period.

19. The process of claim 17, wherein at least one input received from the user comprises a non-linear concentration versus time profile for the selected variation profile over the selected time period.

20. The process of claim 17, wherein at least one input received from the user comprises a minimum concentration and a maximum concentration of the at least one concentrated fluid during the selected time period.

* * * * *